US006792239B2

(12) United States Patent
Lee

(10) Patent No.: US 6,792,239 B2
(45) Date of Patent: Sep. 14, 2004

(54) FUSING ROLLER ASSEMBLY FOR ELECTROPHOTOGRAPHIC IMAGE FORMING APPARATUS

(75) Inventor: Kyung-woo Lee, Suwon-si (KR)

(73) Assignee: Samsung Electronics Co., LTD, Suwon-si (KR)

( * ) Notice: Subject to any disclaimer, the term of this patent is extended or adjusted under 35 U.S.C. 154(b) by 0 days.

(21) Appl. No.: 10/454,673

(22) Filed: Jun. 5, 2003

(65) Prior Publication Data

US 2003/0202828 A1 Oct. 30, 2003

Related U.S. Application Data

(63) Continuation of application No. 09/967,934, filed on Oct. 2, 2001, now Pat. No. 6,580,896.
(60) Provisional application No. 60/257,118, filed on Dec. 22, 2000.

(30) Foreign Application Priority Data

Mar. 15, 2001 (KR) ..... 2001-13451
May 4, 2001 (KR) ..... 2001-24378

(51) Int. Cl.[7] ..... G03G 15/20
(52) U.S. Cl. ..... 399/330; 29/895.21; 219/216; 219/469; 399/333; 492/46
(58) Field of Search ..... 399/328, 330, 399/333; 219/216, 469, 619, 628–630; 118/60; 492/46; 29/895, 895.21

(56) References Cited

U.S. PATENT DOCUMENTS

| | | | | |
|---|---|---|---|---|
| 4,284,875 A | | 8/1981 | Namiki et al. | 219/216 |
| 5,420,392 A | * | 5/1995 | Sakata | 219/216 |
| 5,659,866 A | | 8/1997 | Kim | 399/330 |
| 5,752,150 A | | 5/1998 | Kato et al. | 399/330 |
| 6,571,080 B2 | * | 5/2003 | Lee et al. | 399/330 |
| 2002/0031381 A1 | * | 3/2002 | Miyahara et al. | 399/330 |

FOREIGN PATENT DOCUMENTS

| | | | |
|---|---|---|---|
| CN | 2281556 Y | | 5/1998 |
| EP | 0 772 100 A2 | | 5/1997 |
| EP | 0772100 | | 5/1997 |
| JP | 57-154781 | | 9/1982 |
| JP | 04032885 | | 2/1992 |
| JP | 08-153567 | | 6/1996 |
| JP | 09 197863 A | | 7/1997 |
| JP | 09-197863 | * | 7/1997 |
| JP | 10-240056 | | 9/1998 |
| JP | 2001-242734 | * | 9/2001 |

OTHER PUBLICATIONS

Abstract for the European Search Report No. 01 30 9414.9 dated May 7, 2002.
Abstract for the European Search Report No. 01 31 059.1.1 dated May 15, 2002.
"*Office Action*" issued by Japanese Patent Office dated on Dec. 16, 2003.

* cited by examiner

*Primary Examiner*—Sophia S. Chen
(74) *Attorney, Agent, or Firm*—Robert E. Bushnell, Esq.

(57) ABSTRACT

A structurally improved fusing roller assembly based on the heat pipe principle is provided. The fusing roller assembly includes a fusing roller and a heat pipe coaxially mounted inside the fusing roller. A resistance heater is helically wound around the exterior cylindrical surface of the heat pipe, and rests between the inner cylindrical surface of the fusing roller and the exterior cylindrical surface of the heat pipe. The heat pipe is hermetically sealed with a quantity of a working fluid contained inside. The surface of fusing roller can be instantaneously heated up to a target fusing temperature. The fusing roller assembly can be heated up to a target fusing temperature within a shorter period of time without need for warm-up and stand-by period, so that power consumption decreases.

24 Claims, 18 Drawing Sheets

FUSING ROLLER ASSEMBLY FOR ELECTROPHOTOGRAPHIC IMAGE FORMING APPARATUS

CROSS-REFERENCE TO RELATED APPLICATIONS

This application is a continuation of Applicant's Ser. No. 09/967,934 filed in the U.S. Patent & Trademark Office on Oct. 2, 2001. and assigned to the assignee of the present invention, now U.S. Pat. No. 6,580,896 issued on Jun. 17, 2003.

CLAIM OF PRIORITY

This application makes reference to, incorporates the same herein, and claims all benefits accruing under 35 U.S.C. §119 and §120 from a Korean patent application No. 2001-13451 filed in the Korean Industrial Property Office on 15 Mar. 2001, a Korean patent application No. 2001-24378 filed in the Korean Industrial Property Office on the 4 th of May 2001, and a U.S. provisional patent application Serial No. 60/257,118 filed in the U.S. Patent and Trademark Office on Dec. 22, 2000.

BACKGROUND OF THE INVENTION

1. Field of the Invention

The present invention relates to a fusing roller apparatus for an electrophotographic image forming apparatus, and more particularly, to a fusing roller apparatus for an electrophotographic image forming apparatus, which can be instantaneously heated with low power consumption.

2. Description of the Related Art

In a general electrophotographic image forming apparatus such as a copy machine and laser beam printer, as an electrostatic charging roller adjacent to a photoreceptor drum rotates, a photosensitive material coated on the surface of the photoreceptor drum is uniformly charged. The charged photosensitive material is exposed to a laser beam scanned from a laser scanning unit (LSU) so that a latent electrostatic image is formed in a predetermined pattern on the photosensitive material. A developer unit supplies toner to the photosensitive material to develop the latent electrostatic image formed on the photosensitive material into a visible toner image. A predetermined transfer voltage is applied to a transfer roller which is put in contact with the photoreceptor drum at a predetermined force while the photoreceptor drum carries the toner image. In this state, as a print paper is fed in the gap between the transfer roller and the photoreceptor medium, the toner image formed on the photosensitive material is transferred to the print paper. A fixing unit which includes a fusing roller, instantaneously heats the print paper to which the toner image is transferred to fuse and fix the toner image to the print paper. In general, a halogen lamp is used as a heat source for the fixing unit. The halogen lamp is installed inside the fusing roller and heats the surface of the fusing roller to a target temperature with radiant heat.

In a conventional fusing roller apparatus of an electrophotographic image forming apparatus, which uses a halogen lamp as a heat source, the exterior surface of the fusing roller must generate heat; the fusing roller is therefore heated from the inside out by radiant heat from the halogen lamp. A pressure roller is located below the fusing roller. As paper carrying a toner image in a powder form passes between the fusing roller and the pressure roller, the paper is hot pressed by the predetermined force and the toner image is fused and fixed to the print paper by the heat and force from the fusing roller and the pressure roller.

A thermistor may be used for detecting and converting the surface temperature of the fusing roller into an electric signal and a thermostat may be used to cut off the power supply to the halogen lamp.

A conventional fusing roller apparatus which employs a halogen lamp as a heat source unnecessarily consumes a large amount of power, and needs a considerably long warm-up period when the image forming apparatus is turned on for image formation. In other words, after the application of power, a standby period follows until the temperature of the fusing roller reaches a target temperature, for example, for a few tens of seconds to a few minutes. I have found that with a conventional fusing roller apparatus, because the fusing roller is heated by radiant heat from the heat source, the rate of heat transfer is low. In particular, compensation for temperature variations due to a drop in the temperature of the heat roller caused by contact with a print paper is delayed, so that it is difficult to uniformly control the distribution of temperature along the axial length of the fusing roller. Even in a stand-by mode where the operation of the printer is suspended, power must be periodically applied so as to keep the temperature of the fusing roller constant, thereby causing unnecessary power consumption. Also, it takes a considerable amount of time to switch the fusing roller from its stand-by mode to an operating mode for image output, so that the resultant image cannot be rapidly printed.

An alternative design for a conventional fusing roller apparatus employs a heating plate placed in a lower portion of a flexible cylindrical film tube, with a pressure roller mounted underneath the heating plate. The film tube is rotated by a separate rotation unit and is locally heated and deformed at a part between the heating plate and the pressure roller. While this method of locally heating the film tube with a heating plate was thought to be advantageous in terms of low power consumption, it is unsuitable for high-speed printing.

Japanese Patent Application Nos. sho 58-163836 (Sep. 16, 1983); hei 3-107438 (May 13, 1991), hei 3-136478 (Jun. 7, 1991); hei 5-135656 (Jun. 7, 1993); hei 6-296633 (Nov. 30, 1994); hei 6-316435 (Dec. 20, 1994); hei 7-65878 (Mar. 24, 1995); hei 7-105780 (Apr. 28, 1995); hei 7-244029 (Sep. 22, 1995); hei 8-110712 (May 1, 1996); hei 10-27202(Feb. 9, 1998); hei 10-84137(Mar. 30, 1998); and hei 10-208635 (Jul. 8, 1998) disclose heat-pipe equipped fusing roller apparatus.

Such fusing roller apparatus using heat-pipes can be instantaneously heated, thereby reducing power consumption. Fusing roller apparatus also have a short period of delay when switching between stand-by and a printing operation. In particular, the fusing roller apparatus disclosed in Japanese Patent Application Nos. hei 5-135656; hei 10-84137; hei 6-29663; and hei 10-208635 employ different types of heat sources at one end of the fusing rollers, that are positioned beyond the fixing areas. The arrangement of the heat source for each of these fusing roller apparatus increases the volume of the fusing roller apparatus and requires complex structures. Thus, there is a need to improve the structural complexity of such fusing roller apparatus.

The fusing roller apparatus disclosed in Japanese Patent Application Nos. sho 58-163836; hei 3-107438; hei 3-136478; hei 6-316435; hei 7-65878; hei 7-105780; and hei 7-244029 have their heat sources located within their fusing rollers, so that there remains a problem attributable to the increased volume of this apparatus described above. A plurality of local heat pipes, however, are installed for each fusing roller, thereby complicating fabrication and manufacture of the fusing roller apparatus. The local arrangement of the heat pipes moreover, causes temperature deviations between heat-pipe contact portions and heat-pipe non-contact portions.

SUMMARY OF THE INVENTION

To solve these and other problems in the art, it is an object of the present invention to provide an electrophotographic image forming apparatus and process.

It is another object to provide an improved fusing roller and fusing process.

It is still another object to provide a fusing roller apparatus for an electrophotographic image forming apparatus, in which local temperature deviation of a fusing roller is sharply reduced, thereby improving overall thermal distribution characteristics.

It is yet another object of the present invention to provide a fusing roller apparatus for an electrophotographic image forming apparatus, which is easy to manufacture and is designed to minimize any increase in the size of the fusing roller apparatus.

It is still another object to provide a fusing roller able to progress from its standby state to its printing state in a shorter period of time.

It is also an object to provide a more energy efficient electrophotolithographic process and apparatus.

It is a further object to provide a fusing roller, process for constructing a fusing roller and a process for fusing electrostatic images formed from toner onto a printable medium, with an assembly able to change the temperature of the fusing roller from room temperature to an operating temperature within a shorter period of time.

It is a still further object to provide a fusing roller, process for constructing a fusing roller and a process for fusing electrostatic images formed from toner onto a printable medium, with an assembly that is able to allow -the temperature of the fusing roller to remain at room temperature during a standby operational period.

It is a yet further object to provide a fusing roller, process for constructing a fusing roller and a process for fusing electrostatic images formed from toner onto a printable medium, with an assembly that exhibits an improved thermal equilibrium and minimal local thermal differences on the cylindrical exterior surfaces of the fusing roller.

To achieve these and other objects of the present invention, in a first embodiment there is provided a fusing process and roller apparatus that may be practiced with a heat pipe that is hermetically sealed at both ends to maintain a vacuum within the interior cavity of the heat pipe. The interior cavity of the heat pipe contains a predetermined amount of a working fluid. The heat pipe is installed coaxially inside the hollow interior of a cylindrical fusing roller and a heat-generator is helically wound around the cylindrical exterior of the heat pipe, in the annular clearance between the heat pipe and the cylindrical interior surface of the fusing roller.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
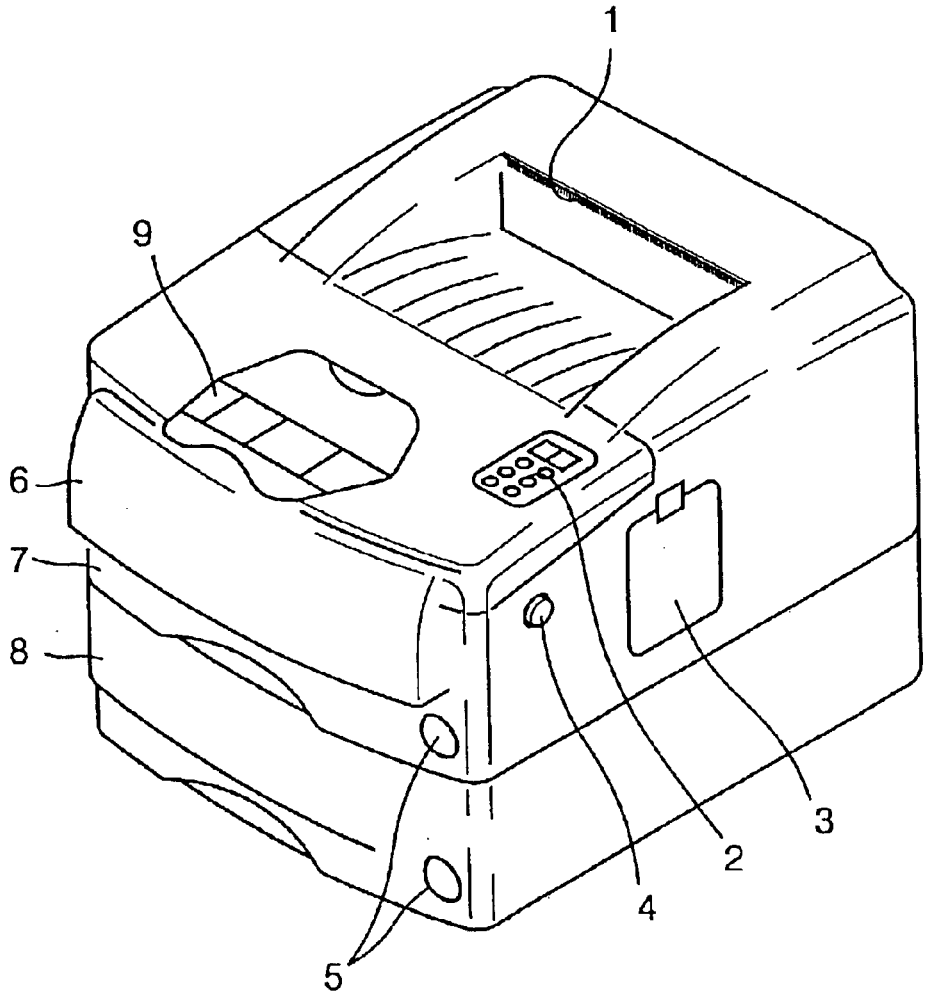
FIG. 1 is a perspective view of a general electrophotographic image forming apparatus.

FIG. 1 shows a general electrophotographic image forming apparatus, with an electrophotographic image forming apparatus that includes a paper ejector 1, a keypad 2, a control board cover 3, an upper-cover opening button 4, paper indication windows 5, a multi-purpose paper feed tray 6, a paper cassette 7, an optional cassette 8, and an auxiliary paper support 9.

Figure 2:
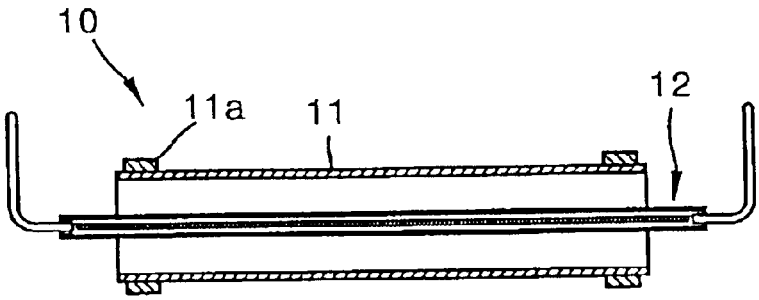
FIG. 2 (PRIOR ART)
FIG. 2 is a sectional view of a conventional fusing roller apparatus of an electrophotographic image forming apparatus.
Figure 3:
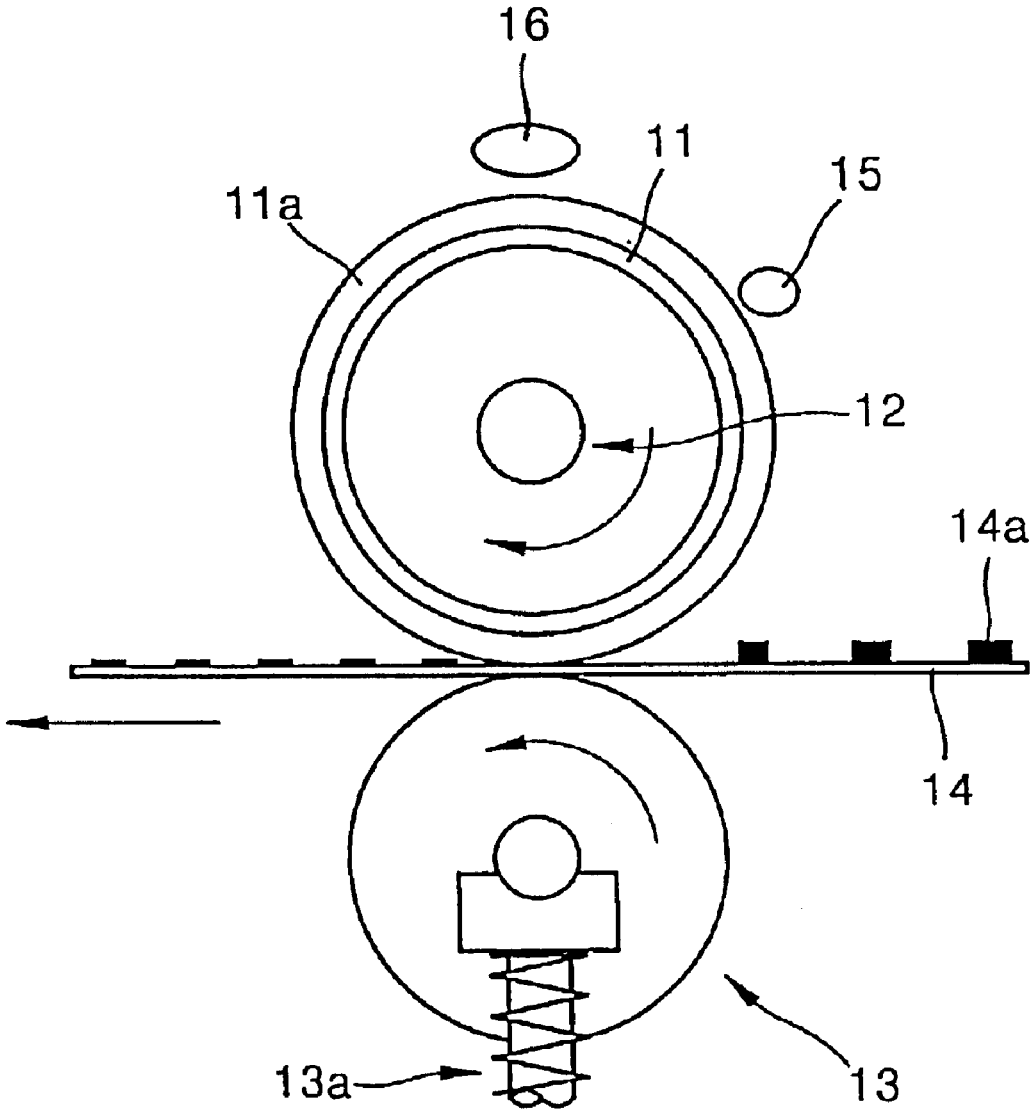
FIG. 3 (PRIOR ART)
FIG. 3 shows the structure of a fixing unit of an electrophotographic image forming apparatus incorporating a conventional fusing roller apparatus.

FIG. 2 is a cross-sectional view of a conventional fusing roller apparatus of an electrophotographic image forming apparatus, which uses a halogen lamp as a heat source. FIG. 3 is a sectional view of the fusing roller of FIG. 2 with the halogen lamp as a heat source and a pressure roller, as used in the conventional electrophotographic image forming apparatus. Referring to FIG. 2, the conventional fusing roller apparatus 10 includes a cylindrical fusing roller 11 having a coated layer 11 a formed of Teflon and a heat-generator 12, such as a halogen lamp, inside the fusing roller 11. As the exterior surface of fusing roller 11 must generate heat, fusing roller 11 is heated from the inside out by radiant heat from heat-generator 12.

Referring to FIG. 3, a pressure roller 13 is located below the fusing roller 11 having a coated layer 11*a* formed of Teflon. The pressure roller 13 is elastically supported by a spring assembly 13*a* to press the print paper 14 passing between the fusing roller 11 and the pressure roller 13 against the fusing roller 11 by a predetermined force. As the print paper 14 carries a toner image 14*a* in a powder form between the fusing roller 11 and the pressure roller 13, the print paper 14 is hot pressed by the predetermined force. In other words, the toner image 14*a* is fused and fixed to the print paper 14 by the heat and force from the fusing roller 11 and the pressure roller 13.

A thermistor 15 is used for detecting and converting the surface temperature of the fusing roller 11 into an electric signal and a thermostat 16 for cutting off the power supply to the heat-generator 12, such as a halogen lamp, are installed adjacent to the fusing roller 11. When the surface temperature of the fusing roller 11 goes beyond a given threshold value, thermostat 16 interrupts electrical power to heat generator 12. The thermistor 15 detects the surface temperature of the fusing roller 11 and transmits the result of the detection to a controller (not shown) for the printer. The controller controls the power supply to the halogen lamp of heat-generator 12 according to the detected surface temperature of the fusing roller 11 to keep the surface temperature within a given range. The thermostat 16 serves as a thermal protector for the fusing roller 11 and neighboring elements, which operates when the thermistor 15 and the controller fail to control the temperature of the fusing roller 11.

A conventional fusing roller apparatus which employs the halogen lamp as a heat source unnecessarily consumes a large amount of power, and needs a considerably long warm-up period when the image forming apparatus is turned on for image formation. In other words, after the application of power, a standby period is followed until the temperature of the fusing roller 11 reaches a target temperature, for example, for a few tens of seconds to a few minutes. For the conventional fusing roller apparatus, because the fusing roller is heated by radiant heat from the heat source, the heat transfer rate is low. In particular, compensation for temperature variations due to a drop in the temperature of the heat roller caused by contact with a print paper is delayed, so that it is difficult to uniformly control the distribution of temperature of the fusing roller 11. Even in a stand-by mode where the operation of the printer is suspended, power must be periodically applied so as to keep the temperature of the fusing roller constant, thereby causing unnecessary power consumption. Also, it takes a considerable amount of time to switch the stand-by mode to an operating mode for image output, so that the resultant image cannot be rapidly output.

Figure 4:
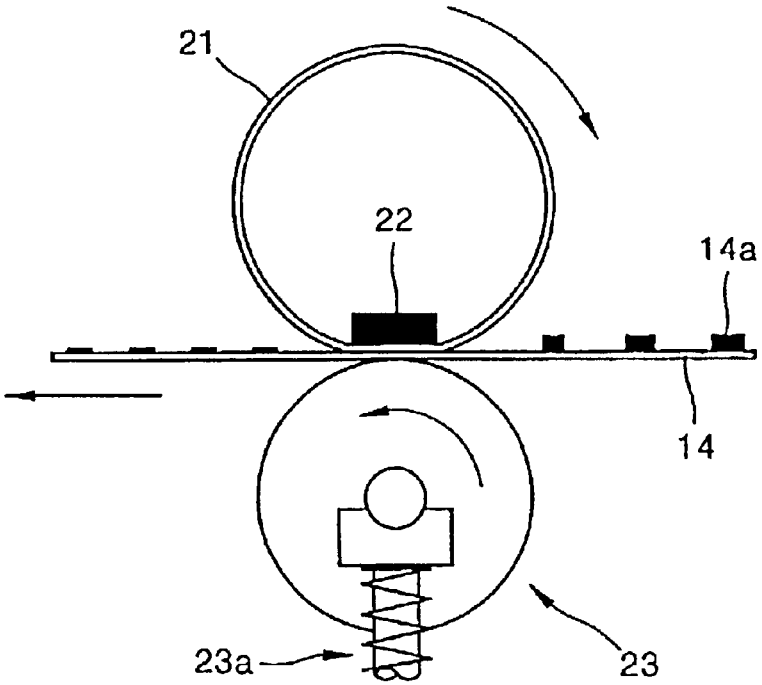
FIG 4 (PRIOR ART)
FIG. 4 shows the structure of a fixing unit of an electrophotographic image forming apparatus that incorporates a different conventional fusing roller apparatus.

FIG. 4 is a sectional view of a conventional fusing roller apparatus applied to an electrophotographic image forming apparatus. Heating plate 22 is placed in a lower portion of a flexible cylindrical film tube 21, and a pressure roller 23 that is elastically supported by spring assembly 23*a*, is mounted underneath the heating plate 22. The film tube 21 is rotated by a separate rotation unit and is locally heated and deformed at a part between the heating plate 22 and the pressure roller 23. This method of locally heating the film tube 21 by the heating plate 22 is advantageous in terms of low power consumption. The local heating method is unsuitable, however, for high-speed printing.

Figure 5:
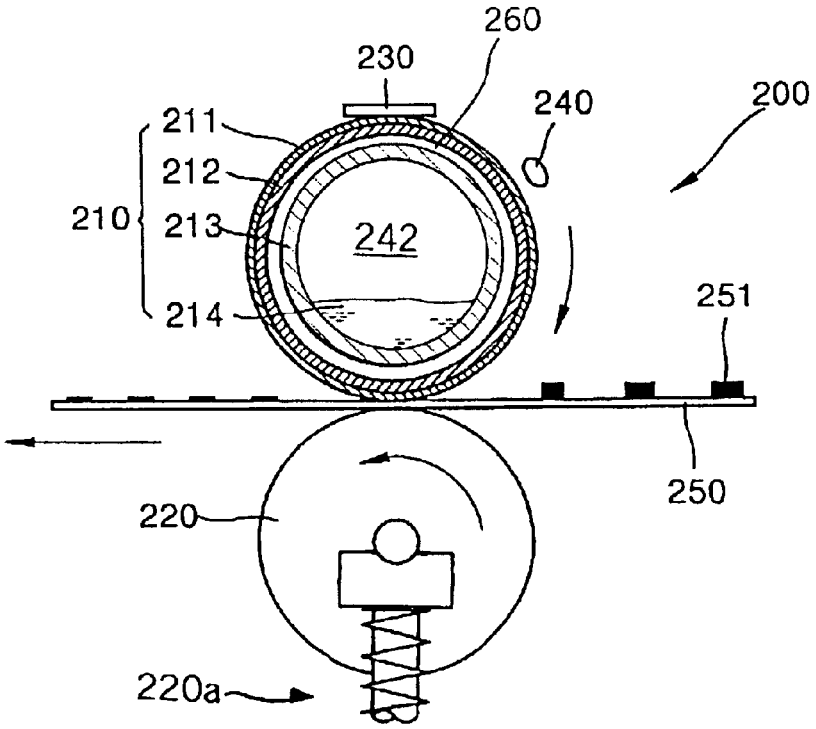
FIG. 5 is a cross-sectional view of a fixing unit of an electrophotographic image forming apparatus that incorporates a first embodiment of a fusing roller apparatus constructed according to the principles of the present invention.
Figure 6:
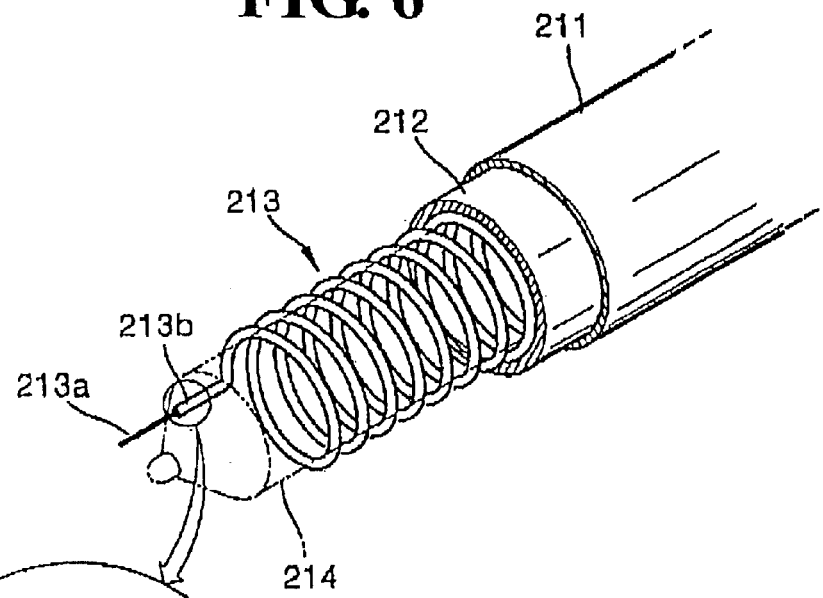
FIG. 6 is a partial perspective view of the structure of the fusing roller apparatus illustrated by FIG. 5 albeit without illustration of details of the heat pipe.
Figure 7:
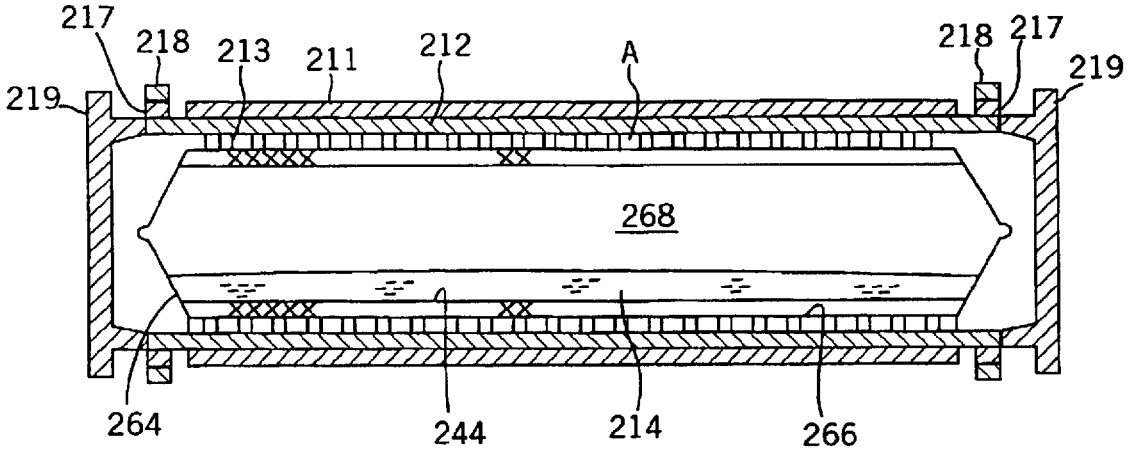
FIG. 7 is a cross-sectional view illustrating the inner structure of the fusing roller apparatus shown by FIGS. 5 and 6.

A fixing unit of an electrophotographic image forming apparatus incorporating a first embodiment of a fusing roller apparatus according to the present invention is shown in FIG. 5, while FIG. 6 is a perspective view of FIG. 5 showing the structure of the fusing roller apparatus in greater detail, and FIG. 7 is a longitudinal sectional view of the fusing roller apparatus of FIGS. 5 and 6.

Figure 6A:
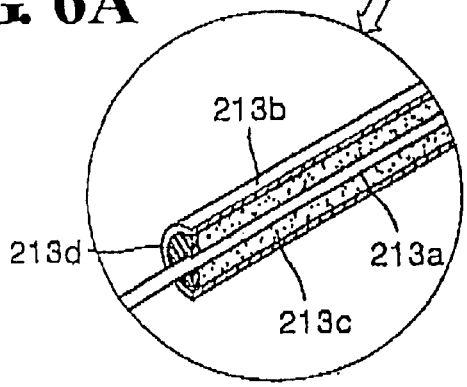
FIG. 6A is a partial cut-away cross-sectional detailed view of a resistance heating coil shown in FIG. 6.

Referring to FIGS. 5, 6 and 6A together, the fixing unit 200 includes a fusing roller apparatus 210 which rotates in a direction in which a print paper 250 bearing a toner image 251 is ejected, i.e., clockwise as viewed in FIG. 5, and a pressure roller 220 that is elastically supported by spring assembly 220*a*, rotates counterclockwise in contact with the fusing roller apparatus 210. The fusing roller apparatus 210 includes a cylindrical fusing roller 212 having a protective outer cylindrical layer 211, which is formed on the surface thereof by coating with Telfon, and a heat-generator 260 installed in the fusing roller 212. A thermistor 230 for sensing the surface temperature of the fusing roller 212 is mounted on the top of the fusing roller 212. The outer Teflon layer 211 is a fluorocarbon resin such as poly tetrafluoroethylene.

A heat-generator 260 is installed within the fusing roller 212 to generate heat using power supplied from an external power supply unit (not shown). Heating generator 260 has an internal heat pipe 262 which is installed within the multiple turns of heating unit 213 with both ends 264 of heat pipe 262 hermetically sealed to maintain a predetermined pressure. The internal heat pipe 262 accommodates a working fluid 214 at a predetermined volume quantity.

A thermistor 230 for sensing the surface temperature of the fusing roller 212 and protective layer 211 is installed above the fusing roller 212 in contact with the protective layer 211. A thermostat 240 for cutting off the power of a power supply unit when the surface temperature of the fusing roller 212 and protective, layer 211 rapidly increases is also installed above the fusing roller 212.

The heating unit 213 is supplied with power from the external power supply unit to generate heat. Preferably, the heating unit 213 is constructed as a spiral resistive heating coil contacting the inside of the fusing roller and the outside of the internal heat pipe 262.

Thermistor 230 is in direct physical contact with protective layer 211 and senses the temperature of the protective layer 211. The inner space formed by the interior cylindrical cavity 242 of the fusing roller 212 is occupied by heat-generator 26O. Heating unit 213 maybe a helical winding of multiple turns made with a spiral resistance heating coil installed along inner cavity 242 in direct physical contact with the inner cylindrical wall off fusing roller 212. The heating unit 213 includes a heat-generating wire 213*a* formed of an electrically resistive material such as either iron chromium (Fe—Cr) or nickel-chromium (Ni—Cr) coil, and an electrically insulating covering layer 213*c* formed of an electrical dielectric material such as magnesium oxide (MgO) protects the heat-generating wire 213*a*. Insulating covering layer 213*c* of the heating unit 213 prevents deformation or characteristic changes in heat-generating wire 213*a*, which are prone to occur over time or are caused by temperature variations in a working fluid 214 to be described later. An outer layer 213*b* made of a relatively inert material such as stainless steel, forms a protective sheath around insulating layer 213*c*. Both ends of the heater 213*a* are not covered with the covering layer 213*b* to form electrical contacts 215 at both ends of the fusing roller 212. Each end of the covering layer 213*b* is finished by a seal 213*d* in order to prevent the dielectric layer 213*c* formed of MgO being exposed to air. Preferably, the seal 213*d* is formed of zirconia ($ZrO_2$) ceramic to improve heat-resistance, corrosion-resistance and endurance. Preferably, the resistance of the heating unit 213 is 25–40Ω with respect to 220 V AC power and 5–20Ω with respect to 110 V AC power.

Figure 6B:
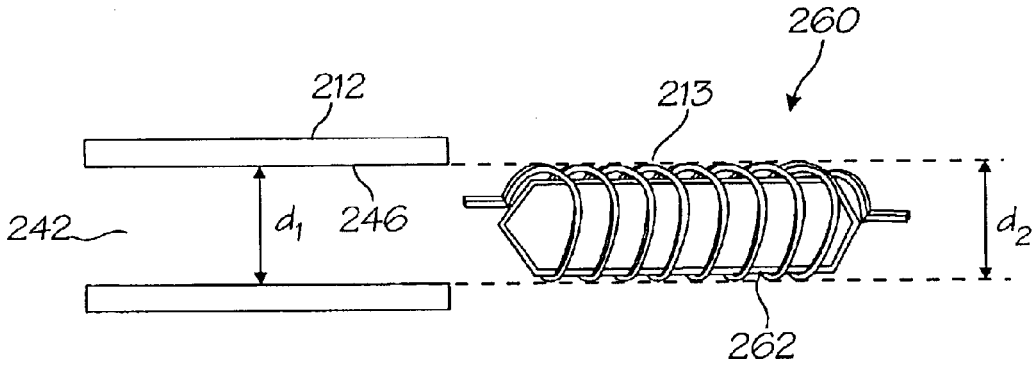
FIGS. 6B, 6C and 6D illustrate a sequence of steps in the construction of a fusing roller apparatus according to the principles of the present invention.
Figure 6C:
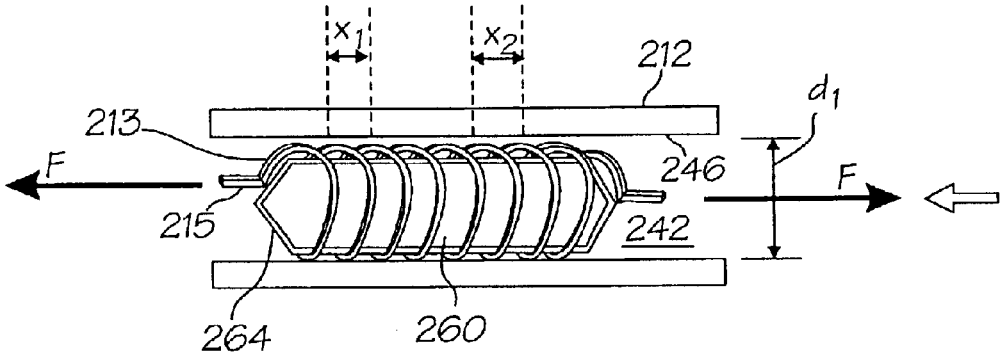
Figure 6D:
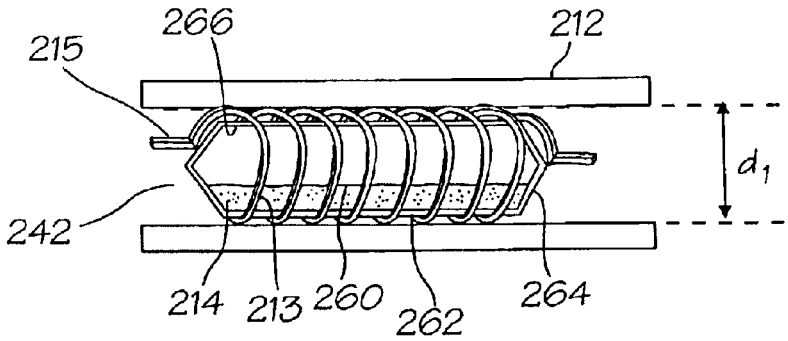

As illustrated in FIGS. 6B, 6C and 6D, the distance between diametrically opposite interior walls of the inner cylindrical surface 246 of fusing roller 212 is $d_1$, while the outer cylindrical surface the multiple turns of heating unit 213 has a diameter of $d_2$. As shown by FIG. 6B, heating unit 213 is spirally wound in multiple turns of a helix, around substantially the entire axial length of the exterior cylindrical surface of heat pipe 262. The average outer cylindrical diameter of the several turns of heating unit 213 is $d_2$, which is slightly greater than $d_1$. As shown in FIG. 6C, opposite axially directed forces F are applied to electrodes 215 at axially opposite ends of coil 213 to reduce the diameter of coil 213 to a value, that is less than $d_1$, while heat pipe 262 together with heating unit 213 are inserted coaxially into the interior cavity 242 of fusing roller 212. As shown FIG. 6D, upon removal of force F, the outer surfaces of each loop of coil 213 are in direct physical and thermal contact with interior circumferential surface 246 of fusing roller 212; in essence, the removal of force F allows coil 213 to assume an outer cylindrical diameter $d_1$, equal to the inner diameter of fusing roller 212. The pitches $x_1$, $x_2$ between neighboring loops of coil 213 are not necessary equal. What is important however, is that most, or all of the exterior surface of each loop of coil 213 lie in direct physical and thermal contact with interior cylindrical surface 246 of heat pipe 212.

Then, as shown by the transition between FIG. 6C and FIG. 6D, once heat generator 260 is installed within the internal cavity 242 of fusing roller 212, air pressure is applied to the interior of heat pipe 262 in order to expand the cylindrical wall of heat pipe 262 radially outwardly until the inner surfaces of heating unit 213 are substantially in direct physical contact with the cylindrical outer surface of heat pipe 262 and simultaneously in direct physical and thermal contact with the interior cylindrical surface 246 of fusing roller 212. The interior cavity of heat pipe 262 is then filled with a predetermined quantity of working fluid 214 and heat pipe 262 is hermetically sealed at a predetermined pressure.

The working fluid 214 is contained in the sealed inner space of heat pipe 262 and the heat-generator is installed around the cylindrical exterior of heat pipe 262. The working fluid 214 is contained in an amount of 5–50% by volume, and preferably, 5–15% by volume based on the inner volume 268 of heat pipe 262. The working fluid 214 prevents local surface temperature deviations of the rotating fusing roller 212, which could otherwise occur due to the presence of the heating unit 213, based on the principles of a heat pipe, and serves as a thermal medium capable of uniformly heating the entire cylindrical volume of heating pipe 262 and simultaneously, of fusing roller 212 within a shorter period of time than is currently available with conventional apparatus. If the amount of the working fluid 214 is less than about 5% by volume based on the volume of the fusing roller 212, a dry-out phenomenon is likely to occur in which the working fluid is not fully vaporized and liquified immediately after vaporization should have otherwise occurred.

Heat pipe 262 may be formed of a stainless steel (such as 304 SS) or copper (Cu). If heat pipe 262 is formed of stainless steel, most of the well-known working fluids, except for water (distilled water) can be used. FC-40 (available from 3M Corporation) is the most preferred alternative to water as working fluid 214. Meanwhile, if the heat pipe 262 is formed of copper, almost all of the well-known working fluids can be used. Water (e.g., distilled water) is the most preferred working fluid for heat pipe 262 made of copper.

End caps 264 are coupled to both of the axially opposite ends of heat pipe 262 to seal the interior cylindrical cavity of heat pipe 262 and thereby form a vacuum tight sealed inner space 268. The axially opposite terminal ends of coil 213 form electrodes 215 that extend axially beyond heat pipe 262 to operationally engage electrical contacts such as slip rings (not shown) that in turn, provide an electrical current through coil 213. Non-conductive bushings 217 and gear-binding caps 218 may also be mounted on the exterior cylindrical surface of fusing roller 212. The electrodes 215 are electrically connected to electrically conducting end leads of heat coil 213 of heat-generator 260. Although the electrical connection that couples the structure of the heat-generator 213 and the electrodes 215 to a source of electrical power is not illustrated in great detail, this structure can be easily implemented.

During operational use, fusing roller apparatus 210 having the structure described above is rotated by a separate rotation unit. For this purpose, additional parts may be installed. For example, a gear-binding cap 212 is an additional part to be coupled to a rotating spur gear required for rotating fusing roller 212.

In a fixing unit 200 of the electrophotographic image forming apparatus constructed according to the principles of the present invention, as an electrical current flows into the heat-generator 260 through electrodes 215, i.e., from an electrical power supply, heat-generator 260 generates heat due to resistance heating as the electrical current flows through helical coil 213 of heat generator 260, and fusing roller 212 is heated from the inside out by the resulting heat. At the same time, working fluid 214 contained in heat pipe 262 is vaporized by the heat. The heat generated by helical coil 213 is transferred to the cylindrical wall of the fusing roller 212, and at the same time the body of the fusing roller 212 is uniformly heated by the vaporized working fluid. As a result, the surface temperature of the fusing roller 212 reaches a target fusing temperature within a substantially shorter period of time.

A wick 244 made of a perforated layer or screen of metal made from copper or stainless steel is formed in a cylindrical shape to serve as a capillary; wick 244 may be placed along interior circumferential surface 266 of heat pipe 262. Suitable materials for heat pipe 262 are listed in Table 2. FC-40 or water (distilled water), previously described, or the materials listed in Table 3 may be used as working fluid 214. When water (distilled water) is selected as working fluid 214, the fusing roller apparatus can be implemented at low cost without environmental concern. Once the temperature of the fusing roller 212 reaches a target fusing temperature at which the toner image is fused, the toner image is transferred (i.e., permanently bonded) to the printable paper. As the printable paper to which the toner image has been transferred absorbs the heat from the fusing roller 212, the vaporized working fluid changes back into its liquid phase inside the cavity 268 of heat pipe 262. The liquefied working fluid may be subsequently heated again by heat-generator 260 to vaporize, so that the temperature of the fusing roller 212 can be maintained at a predetermined temperature.

If the fusing temperature of toner is in the range of 160–180° C., a fusing roller apparatus constructed according to the present invention can reach the target temperature within approximately ten seconds. Then, the surface temperature of the fusing roller 212 is maintained by intermitted application of an electrical current to heating unit 213, within a predetermined range of temperature by the thermistor 230 in response to the surface temperature of the fusing roller 212 sensed by thermistor 230. If the thermistor 230 and a controller fail to properly control the surface temperature so that the surface temperature of fusing roller 212 suddenly rises, a thermostat 240 located in close operational proximity to the cylindrical surface of fusing roller 212 senses the surface temperature of the fusing roller 212 and cuts off the supply of electrical current to coil 213 to prevent overheating. The power supply operation may be varied depending on the target temperature. It will be appreciated that the power supply operation can be controlled by such control techniques as periodic power on/off control or a duty cycle ratio.

A fusing roller apparatus having the configuration described in the forgoing paragraphs may be manufactured by the steps of:

(a) preparing a metal pipe as a material for the fusing roller;

(b) preparing a metal tube as the structure for a heat pipe;

(c) cleaning the exposed surfaces of the metal pipe and the metal tube by washing the metallic pipe and the metal tube with distilled water or volatile liquid;

(d) cleaning the exposed surfaces of a spiral resistance heating coil by washing the spiral resistance heating coil with distilled water or volatile liquid;

(e) winding the spiral resistance heating coil as a helical coil with an outer diameter that is equal to or slightly larger than the inner diameter of the metal pipe, into the annular outer cylindrical volume of the heat pipe;

(f) optionally, inserting a wick formed as a cylinder, to line the interior cylindrical surface of the heat pipe;

(g) sealing opposite base ends of the heat pipe with end caps such that a working fluid inlet remains, while both end leads of the resistance heating coil helically wound around the heat pipe serve as electrical leads;

(h) inserting the heat pipe bearing the helically wound heating coil, coaxially into the interior of the metal pipe;

(i) inflating the sealed heat pipe with a high pressure inert gas, to radially expand the cylindrical shell of the heat pipe until either the windings of the heating coil make direct physical and thermal contact simultaneously with both the inner cylindrical surface of the fusing roller and the outer cylindrical surface of the heat pipe or alternatively, the radial air gap separation between the outer cylindrical surface of the heat pipe and the inner cylindrical surface of the fusing roller, is minimized;

(j) purging extraneous gases from the inner volume of the heat pipe by evacuating, heating, and cooling the heat pipe to exhaust gases from the inner volume of the pipe to create a vacuum within the inner volume;

(k) injecting 5–50% by volume, a working fluid (such as either FC-40 or distilled water) through a working fluid inlet into the interior cavity of the heat pipe;

(l) sealing the working fluid inlet of the heat pipe;

(m) spray-coating the surface of the metal pipe with Teflon, and drying and polishing the metallic pipe to form a protective coating on the fusing roller;

(n) inserting a non-conductive brushing as a bearing into one end of the fusing roller; and (o) mounting a gear-mounting cap made of metal, heat-resistant plastic, or epoxy at the one end of the fusing roller assembly.

During the manufacture of the fusing roller apparatus, when weld-capping the metallic pipe with end caps 264 at axially opposite base ends after the insertion of a wick 244, if a wick is to be used, argon gas is injected into interior cavity 268 of the metal tube via the working fluid inlet for the purpose of preventing oxidation of the heat pipe. Before injecting the working fluid into the heat pipe, extraneous gases are purged from the inner volume 268 and the inner volume is evacuated and is repeatedly heated and cooled under a vacuum so as to exhaust all gases out of the inner volume of the heat pipe, thereby removing substantially all foreign substances adhering to the inner wall of the heat pipe. For example, in one process for purging interior cavity 268, the heat pipe must be heated to a temperature of 250° C. with an internal pressure of forty (40) atmospheres. At room temperature, interior cavity 268 should have a perfect pressure; that is, there should be no molecules within cavity 242.

Figure 8:
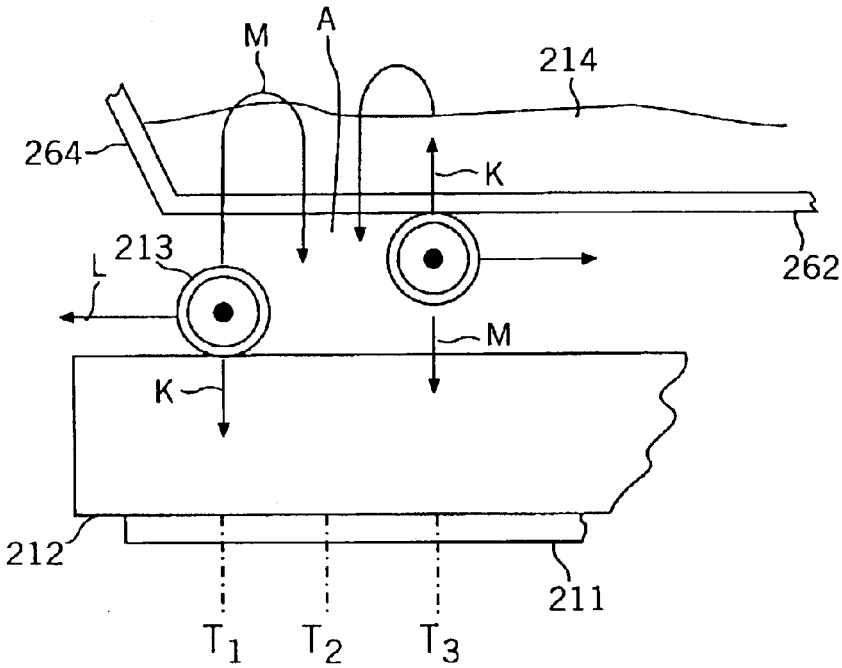
FIG. 8 is a cross-sectional detail illustrating a mode of operation of the embodiment shown in FIG. 7.
Figure 9:
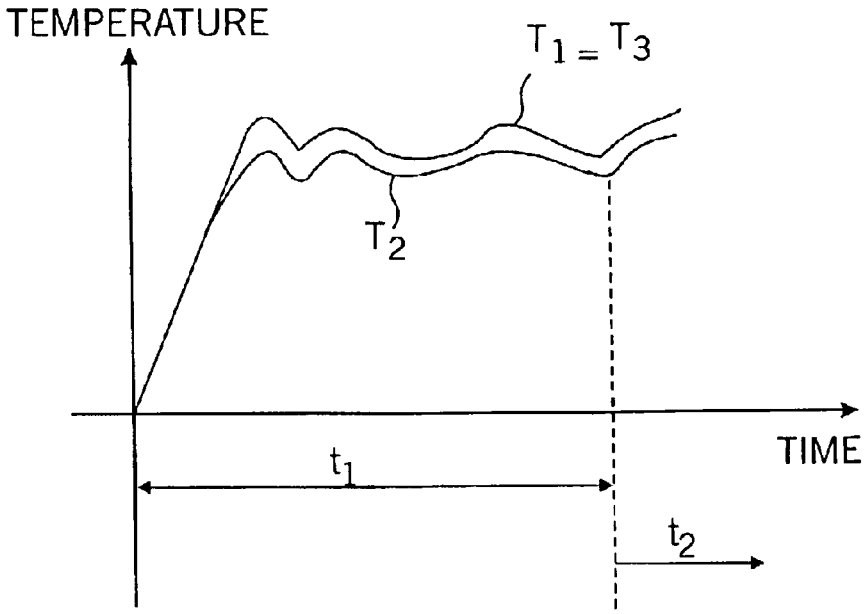
FIG. 9 is a two-coordinate graph illustrating change in temperature as a function of time.
Figure 11:
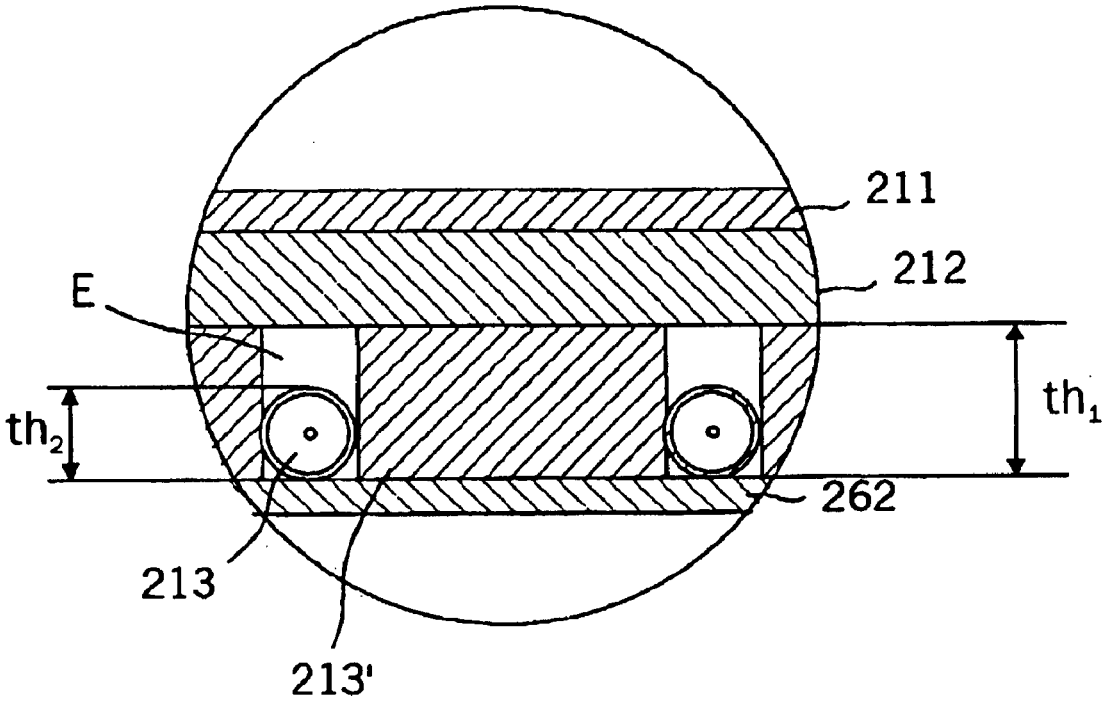
FIG. 11 is a partial longitudinal sectional view showing a detail XI identified in FIG. 10 describing the fusing roller apparatus illustrated by FIG. 8.

FIGS. 8 and 9 illustrate the thermal mode of operation of the embodiment shown in FIG. 7. The individual turns of heating unit 213 either directly heat fusing roller 212 or heat pipe 262 by thermal conduction, as indicated by arrows K and indirectly heat the air space represented by gap A between neighboring turns of heating unit 213, as indicated by arrows L. Depending upon the radial placement of individual turns of heating unit 213, those turns also indirectly heat either working fluid 214 or fusing roller 212, by radiant heating, as indicated by arrows M. Temperature $T_1$, $T_3$ taken in radial alignment with two neighboring turns of heating unit 213 provides substantially identical rise time and temperature profile, as shown by FIG. 9 over both the transient time $t_1$ and the transient time $t_2$. Temperature $T_2$, measured within gap A between those two neighboring turns of heating unit 213, initially follows temperature $T_1$, $T_3$, but subsequently lags those temperatures with lower temperature measurement, over the transient temperature rise time $t_1$. Subsequently, during the quiescent period $t_2$, all three temperatures are substantially identical.

Referring to FIGS. 7 and 10 through 13, an intermediate portion, or spacer 213' maybe inserted between heat pipe 262 and fusing roller 212 for transmitting heat from the heating unit 213 and the heat pipe 262 to the fusing roller 212, in a gap A between adjacent spirals of a resistive heating unit 213. Preferably, the height $th_1$ of spacer 213' is equal to the height $th_2$ of the heating unit 213 or greater to form a space E as large as the difference between the height $th_1$ of 213' and the height $th_2$ of the heating unit 213. The space E contains air, so that heat generated by the heating unit 213 is transmitted to the fusing roller 212 as radiant heat via the air.

By using spacer 213' filling the gap A and transmitting heat from a heating coil and heat pipe 262 to fusing roller 212, heat conductivity can be considerably enhanced with the design shown by FIGS. 7, 10, 11 and 12 compared to a design that uses only a heating coil for heat transmission, and the temperature of the entire fusing roller 212 is uniformly increased to a target temperature. Accordingly, it is preferable to use a material having excellent heat conductivity, particularly, with a group 10 material such as aluminum (Al), used to construct spacer 213'.

Heat pipe 262 has a right cylindrical pipe shape and is hermetically sealed at both of its ends. A predetermined amount of the working fluid 214 is contained in the internal cavity 268 of heat pipe 262. Preferably, a netlike wick structure 244 is provided on the inside of heat pipe 262 so that heat from the heating unit 213 can be uniformly transmitted throughout the interior of heat pipe 262 within a short time. It is apparent that various modifications can be made for uniform beat transmission throughout heat pipe 262.

The working fluid 214 is evaporated due to heat generated and transmitted from the heating unit 213 and transmits the heat to the fusing roller 212, thereby functioning as a thermal medium which prevents significant difference in the surface temperature over the axial length of the fusing roller 212, and heats the entire fusing roller 212 within a very short time. For this function, the working fluid 214 has a volume rate of 5–50%, preferably, 5–15%, with respect to the volume of the internal cavity 268. When the volume rate of the working fluid 214 is no greater than about 5%, a probability of dry-out phenomenon is very high. Accordingly, it is preferable to avoid a design that uses working fluid 214 having a volume that is no greater than 5% of the volumetric capacity of cavity 268.

The working fluid 214 is selected according to the material of the heat pipe 262. In other words, when the heat pipe 262 is formed of stainless steel, it is not preferable to use water, that is, distilled water, as the working fluid 214. Except for distilled water, most working fluids known up to now can be used. It is most preferable to use FC-40 manufactured by the 3M Corporation.

Figure 10:
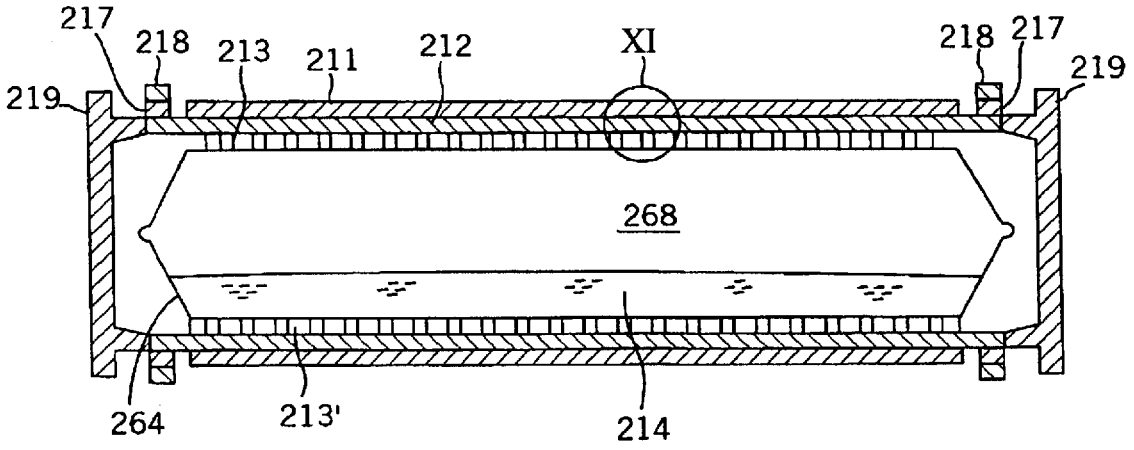
FIG. 10 is a cross-sectional view of a second embodiment of a fusing roller apparatus constructed according to the principles of the present invention.
Figure 12:
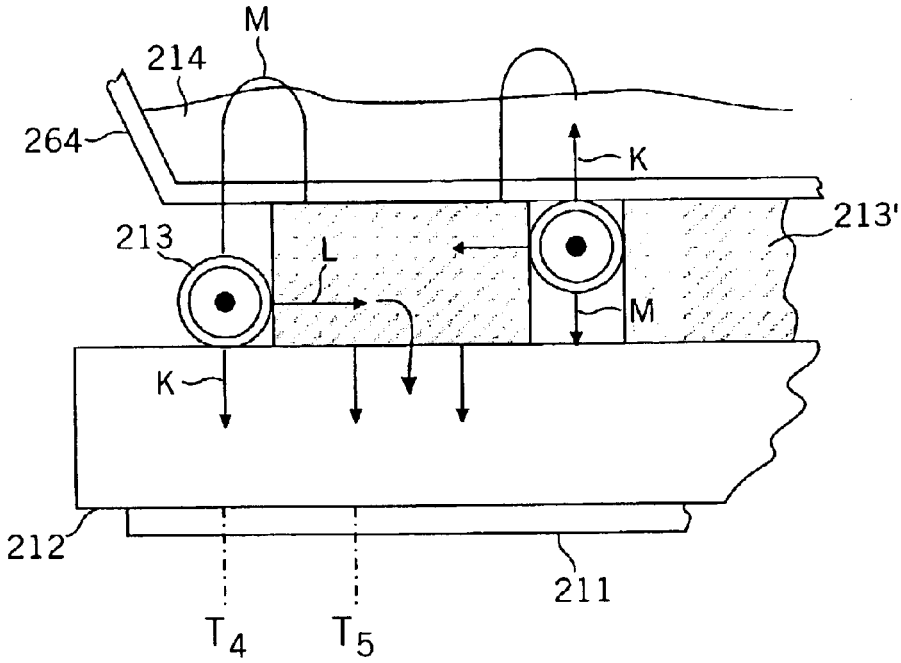
FIG. 12 is a cross-sectional detail illustrating a mode operation of the embodiment shown by FIG. 10.
Figure 13:
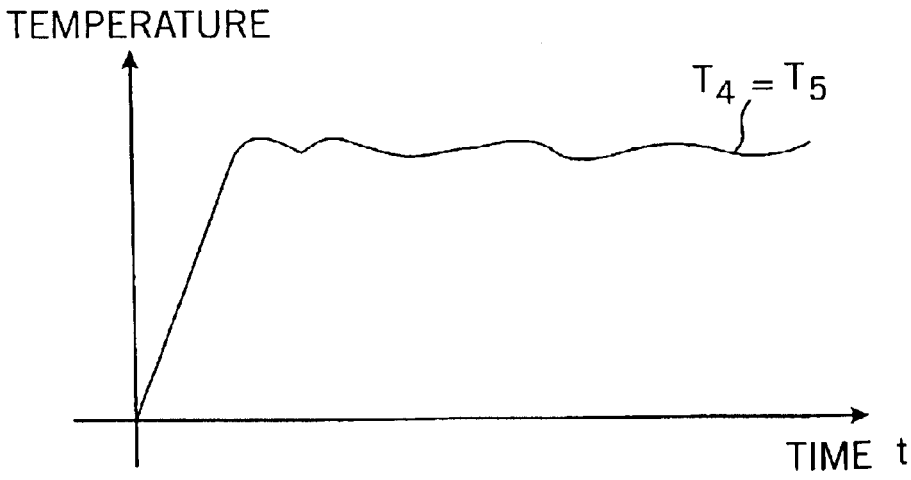
FIG. 13 is a two-coordinate graph illustrating change in temperature as a function of time.

FIGS. 12 and 13 illustrate the thermal mode of operation of the embodiment shown by FIG. 10. As indicated by arrows K, neighboring windings of heating unit 213, depending upon their radial disposition, may heat either fusing roller 212 or heat pipe 262 and working fluid 214 by direct thermal conduction. The neighboring turns may, due to their immediate proximity to intervening spacer 213', also directly heat spacer 213', as indicated by arrows L. Spacer 213' also directly heats fusing roller 212 by thermal conduction. These turns of heating unit 213 also, and again depend upon their radial disposition, indirectly heat fusing roller 212 and working fluid 214, as indicated by arrows M. Measurements of temperatures $T_4$, $T_5$ at the surfaces of the Teflon coating 211 on fusing roller 212, in radial alignment respectively with one turn of heating unit 213 and the spacer 213' between two neighboring turns of heating unit 213, are identical both during a transient and quiescent period of time, as shown by FIG. 13. Consequently, the spacers provide almost identical, but certainly uniformity in external temperature of the heating roller along its entire axial length. It should be noted that the diameter of each turn of heating unit 213 should be approximately equal, but will most likely be somewhat less in value than the radial cross-sectional dimension of the intermediate spacer 213'.

Spacer 213' may be made of type 10 aluminum while the fusing roller 212 is made of type 60 aluminum. Type 10 aluminum is more easily deformed however, and the spacer 213' is therefore more flexible. If heat pipe 262 is made of either copper or aluminum, when inflated by high pressure of air, the cylindrical shell of heat pipe 262 will be distorted and spacer 213' deformed to the point that both the radially inner and radially outer surface of the series 10 aluminum spacer 213' make direct physical and thermal contact simultaneously with both the outer diameter of heat pipe 262 and the interior diameter of type 60 aluminum fusing roller 212; the type 60 aluminum fusing roller however, will be not deformed. The hardness of type 50 aluminum is greater than type 60 series aluminum, and the hardness of both type 50 and type 60 series aluminum is greater than the hardness of type 10 aluminum. The heat transfer characteristics of type 50, type 60 and type 10 series aluminum are substantially equal and the electrical conductivity of type 50, type 60 and type 10 series aluminum are substantially identical.

A fusing roller apparatus having the configuration for the second embodiment described in the foregoing paragraphs may be manufactured by th steps of:

(a) preparing a metal pipe as a material for the fusing roller;

(b) preparing a metal tube as the structure for a heat pipe;

(c) cleaning the exposed surfaces of the metal pipe and the metal tube by washing the metallic pipe and the metal tube with distilled water or volatile liquid;

(d) cleaning the exposed surfaces of a spiral resistance heating coil by washing the spiral resistance heating coil with distilled water or volatile liquid;

(e) optionally, inserting a wick formed as a cylinder, to line the interior cylindrical surface of the heat pipe;

(f) winding the spiral resistance heating coil as a helical coil with an outer diameter that is equal to or slightly larger than the inner diameter of the metal pipe, into the annular outer cylindrical volume of the heat pipe with a continuous spacer of a thermally conducting material (such as type 10 aluminum) separating individual turns of the spiral heating coil, interposed between the outer cylindrical surface of the heat pipe and the inner cylindrical surface of the fusing roller;

(g) sealing opposite base ends of the heat pipe with end caps such that a working fluid inlet remains, while both end leads of the resistance heating coil helically wound around the heat pipe serve as electrical leads;

(h) inserting the heat pipe bearing the helically wound heating coil, coaxially into the interior of the metal pipe;

(i) inflating the sealed heat pipe with a high pressure inert gas, to radially expand the cylindrical shell of the heat pipe until- the windings of spacer make direct physical and thermal contact simultaneously with both the inner cylindrical surface of the fusing roller and the outer cylindrical surface of the heat pipe;

(j) purging extraneous gases from the inner volume of the heat pipe by evacuating, heating, and cooling the heat pipe to exhaust gases from the inner volume of the pipe to create a vacuum within the inner volume;

(k) injecting 5–50% by volume, a working fluid (such as either FC-40 or distilled water) through a working fluid inlet into the interior cavity of the heat pipe;

(l) sealing the working fluid inlet of the heat pipe;

(m) spray-coating the surface of the metal pipe with Teflon, and drying and polishing the metallic pipe to form a protective coating on the fusing roller;

(n) inserting a non-conducive brushing as a bearing into one end of the fusing roller; and (o) mounting a gear-mounting cap made of metal, heat-resistant plastic, or epoxy at the one end of the fusing roller assembly.

For easy understanding of the fusing roller apparatus operating in accordance with the present invention, the heat pipe associated with the present invention will be described. The term heat pipe refers to a heat transfer device that transfers heat from a high-heat density state to a low-heat density state using the latent heat required for the phase change of the working fluid from its liquid phase to its gaseous phase. Since the heat pipe utilizes the phase changing property of the working fluid, its coefficient of thermal conductivity is higher than any known metal. The coefficient of thermal conductivity of a heat pipe operating at room temperature is a few hundreds times greater than either silver or copper having a coefficient of thermal conductivity, k, of 400 W/mk.

Figure 14:
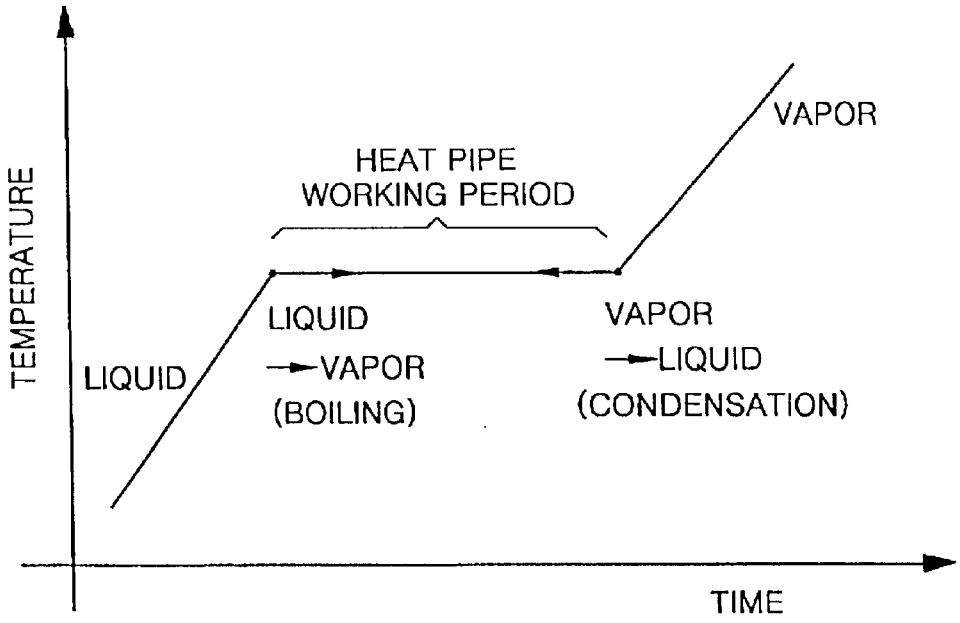
FIG. 14 is a graph illustrating the phase change of a working fluid illustrated as a function of temperature rise and the heat pipe working period of the heat pipe.

FIG. 14 is a graph illustrating the phase change of a working fluid as a function of temperature rise and the heat pipe working period. Table 1 shows the effective thermal conductivity of the heat pipe and other heat transfer materials.

TABLE 1

| Material | Effective Thermal Conductivity (W/mK) |
|---|---|
| Heat pipe | 50,000–200,000 |
| Aluminum | 180 |
| Copper | 400 |
| Diamond | 2,000 |

4.18J of energy are required to raise the temperature of 1 kg of water from 25° C. to 26° C. When the phase of the water changes from liquid to vapor without a temperature change, 2,442 kJ of energy is required. The heat pipe transfers about 584 times greater latent heat through the liquid-vapor phase change. For a heat pipe working at room temperature, the coefficient of thermal conductivity is a few hundreds times greater than either silver or copper that are known as excellent thermal conductors. The thermal conductivity of a heat pipe using a liquid metal as a working fluid working at high temperature amounts to $10^8$ W/mK.

Figure 15:
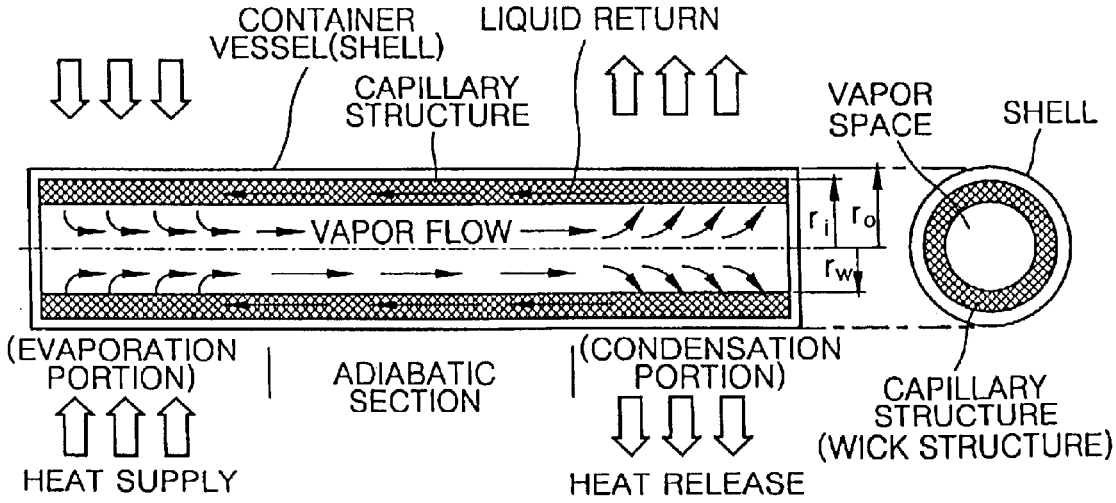
FIG. 15 shows the internal structure of the heat pipe and the heat transfer marked to indicate the liquid-vapor phase change.

FIG. 15 shows the internal structure of a heat pipe incorporating a wick to provide a capillary structure within the interior of the heat pipe, and its heat transfer process according to the liquid-to-vapor and the vapor-to-liquid phase changes. As illustrated in FIG. 15, $r_w$ is the inner radius of the wick, $r_i$ is the inner radius of the heat pipe and $r_o$ is the outer radius of the heat pipe. The resistance heating coil (not separately shown in FIG. 15) and the wick are arranged in a cylindrical shape and are respectively mounted directly against the exterior cylindrical surface and directly against the interior circumferential surface of the heat tube. Table 2 shows the recommended and NOT-recommended heat pipe materials for a variety of working fluids.

TABLE 2

| Working fluid | Recommended | NOT recommended |
|---|---|---|
| Ammonia | Aluminum, Carbon steel, Stainless steel, Nickel | Copper |
| Acetone | Aluminum, Copper, Stainless steel, Silica | — |
| Methanol | Copper, Stainless steel, Nickel, Silica | Aluminum |
| Water | Copper, 347 Stainless steel | Aluminum, Stainless steel, Nickel, Carbon steel, Inconel, Silica |
| Thermex | Copper, Silica, Stainless steel | — |

Table 3 shows a variety of suitable working fluids for different working temperature ranges.

TABLE 3

| Extreme low temperature (−273 ~ −120° C.) | Low temperature (−120 ~ −470° C.) | High temperature (−450 ~ −2700° C.) |
|---|---|---|
| Helium<br>Argon<br>Nitrogen | Water<br>Ethanol<br>Methanol, Acetone, Ammonia, Freon | Cesium<br>Sodium<br>Lithium |

We have found that there are several considerations in selecting a working fluid: 1) compatibility with the material of the heat pipe used; 2) a working fluid that is appropriate working temperature within the heat pipe; and 3) thermal conductivity of the working fluid.

When a heat pipe type fusing roller is formed of stainless steel (SUS) or copper (Cu), suitable working fluids are limited in terms of the compatibility with the material of heat pipe and the working temperature. FC-40 has a one atmosphere or less saturation pressure at a working temperature of 165° C. and is considered to be a relatively suitable material.

FC-40 is known to be non-toxic, non-flammable and compatible with most metals. FC-40 also has a zero-ozone depletion potential. According to the thermodynamics of FC-40 as a working fluid, the relation between the saturation temperature and pressure is expressed by formula (1):

$$\log_{10} P(torr) = A - \frac{B}{(T + 273)} \tag{1}$$

where A=8.2594, and B=2310, and temperature T is measured in degrees Celsius.

Figure 16:
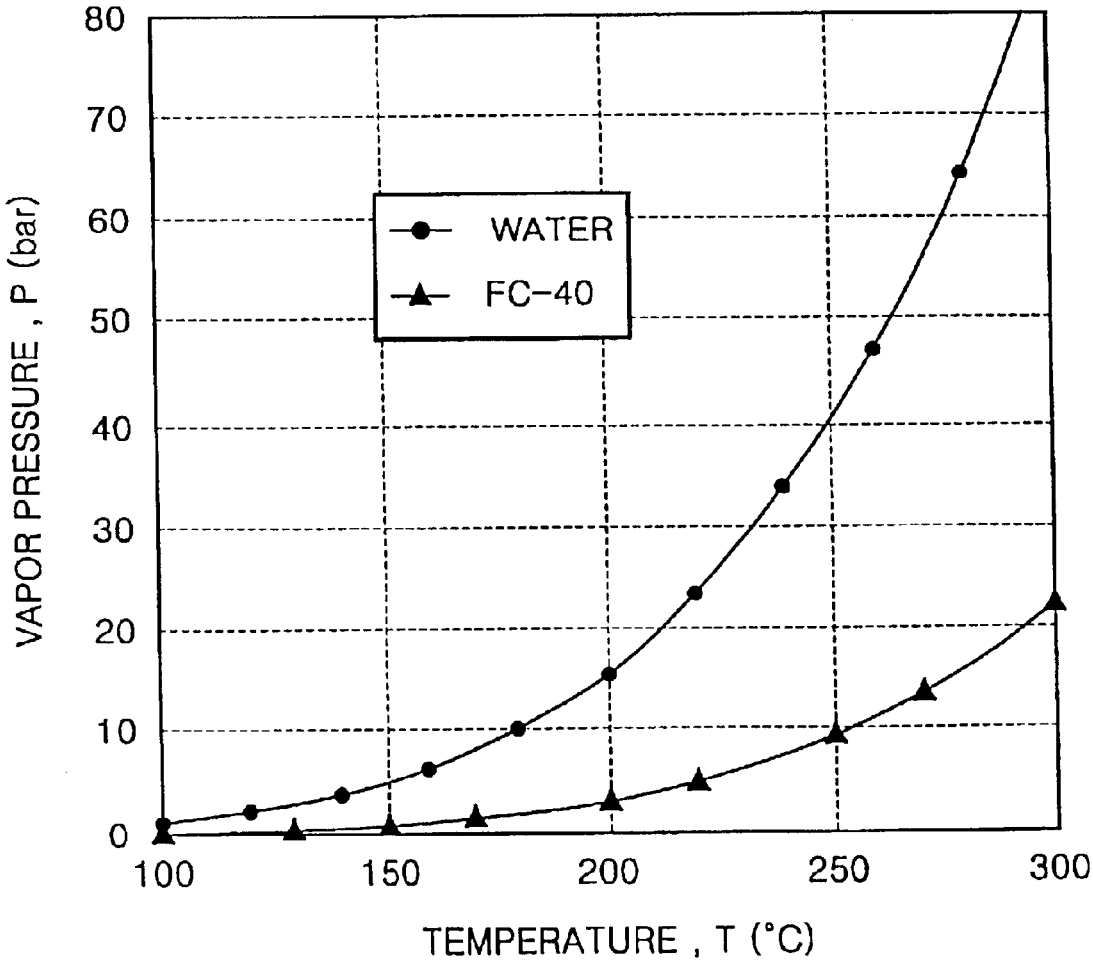
FIG. 16 is a graph showing the saturation pressure variations as a function of the saturation temperatures for FC-40 and distilled water used separately as a working fluid.

FIG. 16 is a graph showing the saturation pressure variations with respect to saturation temperature for FC-40 and water as a working fluid. Table 4 shows the saturation pressures of FC-40 at particular saturation temperatures taken from FIG. 14.

TABLE 4

| Saturation Temperature (° C.) | Saturation Pressure (bar) |
|---|---|
| 100 | 0.15 |
| 150 | 0.84 |
| 200 | 3.2 |
| 250 | 9.3 |
| 300 | 22.54 |
| 350 | 47.5 |
| 400 | 89.5 |
| 450 | 154.6 |

In terms of safe operation of the heat pipe, suitable materials for the heat pipe and the thickness of its end cap are determined according to the American Society of Mechanical Engineers (i.e., ASME) code which is a safety measuring standard for pressure containers. For example, if the thickness of a cylindrical heat pipe is within 10% of its diameter, maximum stresses applied to the wall ($\sigma_{max(1)}$) and semispherical end cap ($\sigma_{max(2)}$) of the heat pipe are expressed as:

$$\sigma_{max(1)} = \frac{\Delta P d_0}{2th_4} \quad (2)$$

$$\sigma_{max(2)} = \frac{\Delta P d_0}{2th_2} \quad (3)$$

where ΔP is difference in pressure between inside and outside the heat pipe, $d_0$ is the outer diameter of the heat pipe, $th_3$ is the thickness of the heat pipe, and $th_4$ is the thickness of the end cap.

According to the ASME code, the maximum allowable stress at an arbitrary temperature is equal to 0.25 times the maximum ultimate tensile strength at that temperature. If the vapor pressure of a working fluid in the range of the heat pipe is working temperature is equal to the saturation vapor pressure of the working fluid, the difference in pressure (ΔP) is equal to the difference between the vapor pressure and atmospheric pressure.

Figure 17:
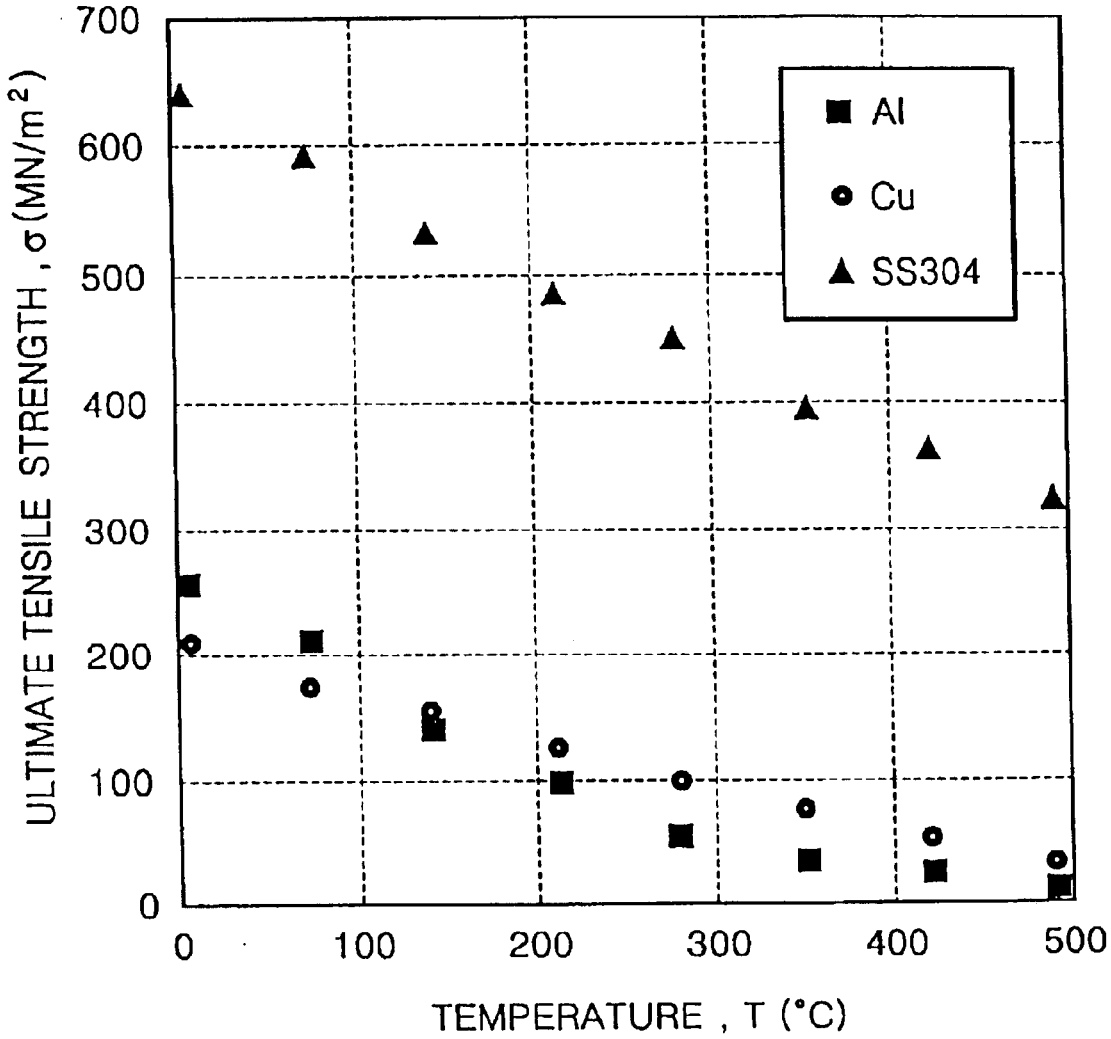
FIG. 17 is a graph of the ultimate tensile strength variations as a function of the temperature variations for the heat pipe materials of aluminum, copper and 304 stainless steel.
Figure 18A:
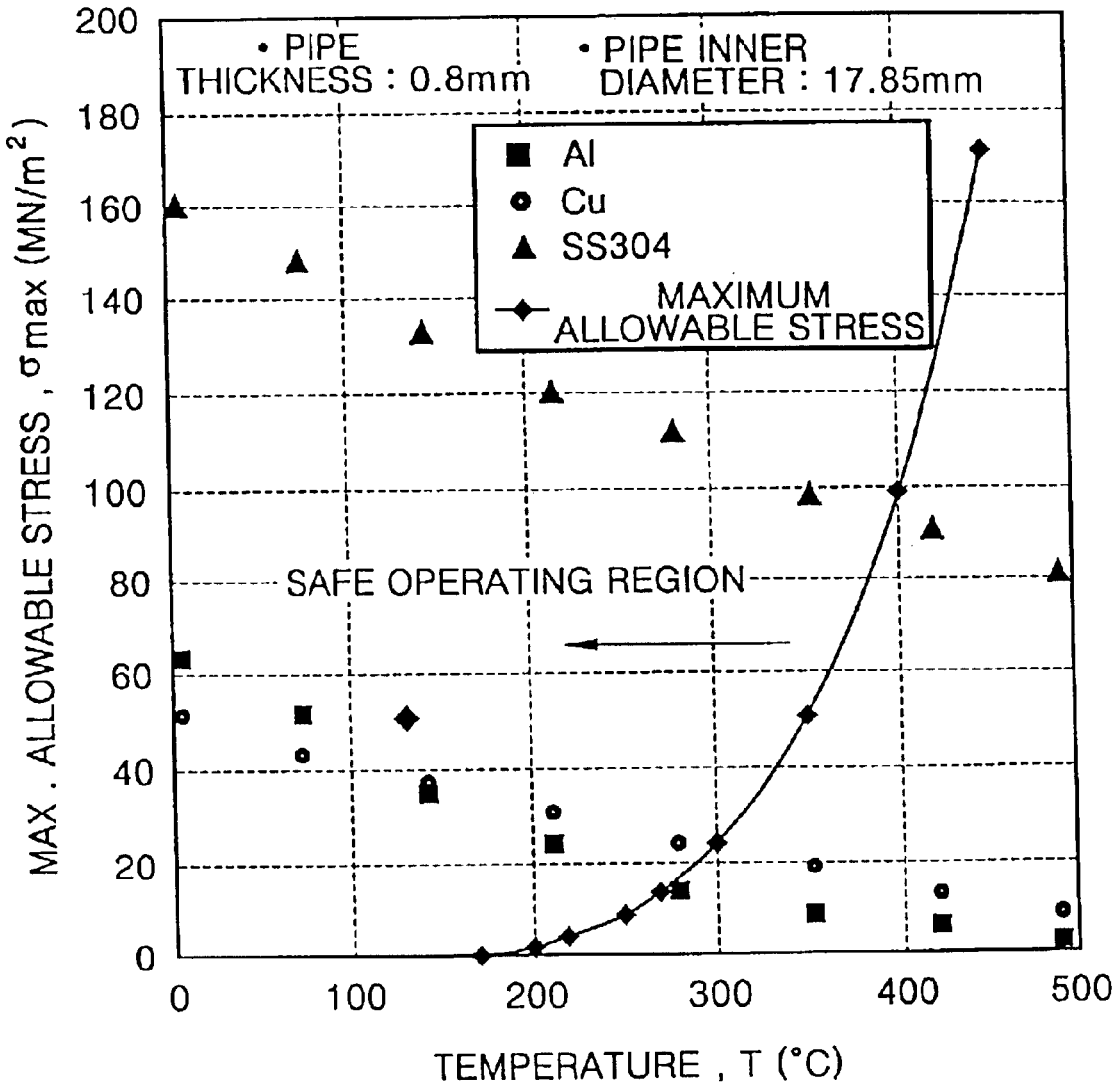
FIGS. 18A and 18B are graphs illustrating the maximum allowable stress and the maximum stress variations upon the heat pipe wall with respect to temperature variations when FC-40 and distilled water are respectively used as a working fluid.
Figure 18B:
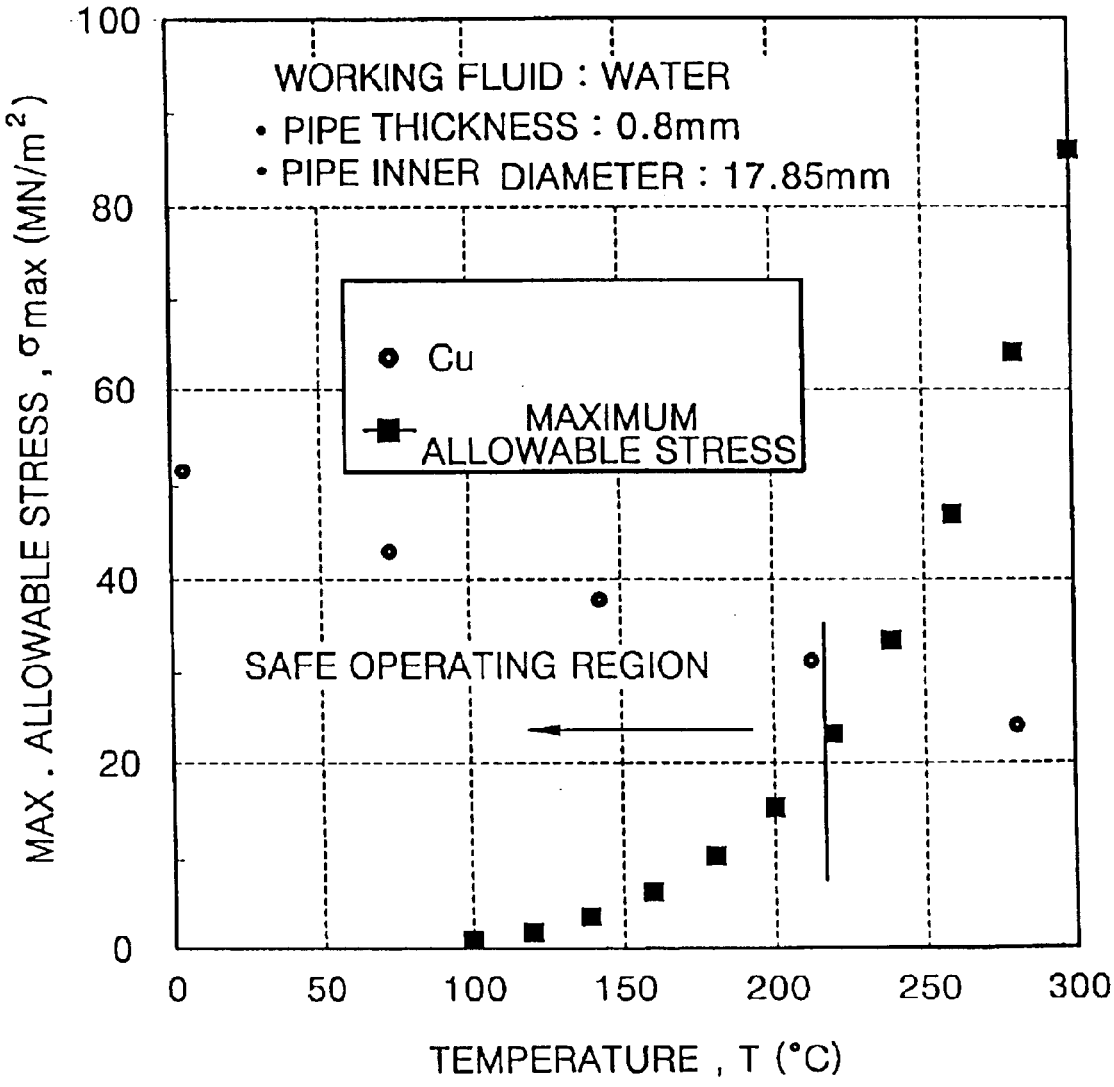

FIG. 17 is a graph of the ultimate tensile strength variations for a variety of heat pipe materials as a function of temperature variations for three different constructions of fusing rollers made with heat pipes of aluminum (Al), copper (Cr) and 304 stainless steel (SS304), taken over a temperature range extending between approximately 0° C. and approximately 500° C. FIG. 18A is a graph showing the maximum allowable stress and variations of maximum stress acting upon the heat pipe wall with respect to temperature variations when FC-40 is used as a working fluid for heat pipes constructed of aluminum, copper and 304 stainless steel. FIG. 18B is a graph of variations of maximum stress acting upon copper heat pipe wall with respect to temperature variations when distilled water is used as a working fluid over a temperature range extending between approximately 0° C. and approximately 500° C., for heat pipes constructed of aluminum, copper and 304 stainless steel. As shown in FIG. 18A, the maximum allowable stress of the stainless steel (SS304) is much greater than that of either copper or aluminum. Safe operation without working leakage of the fluid is ensured for a heat pipe and end caps constructed of stainless steel (SS304) up to a working temperature of about 400° C.

Figure 19A:
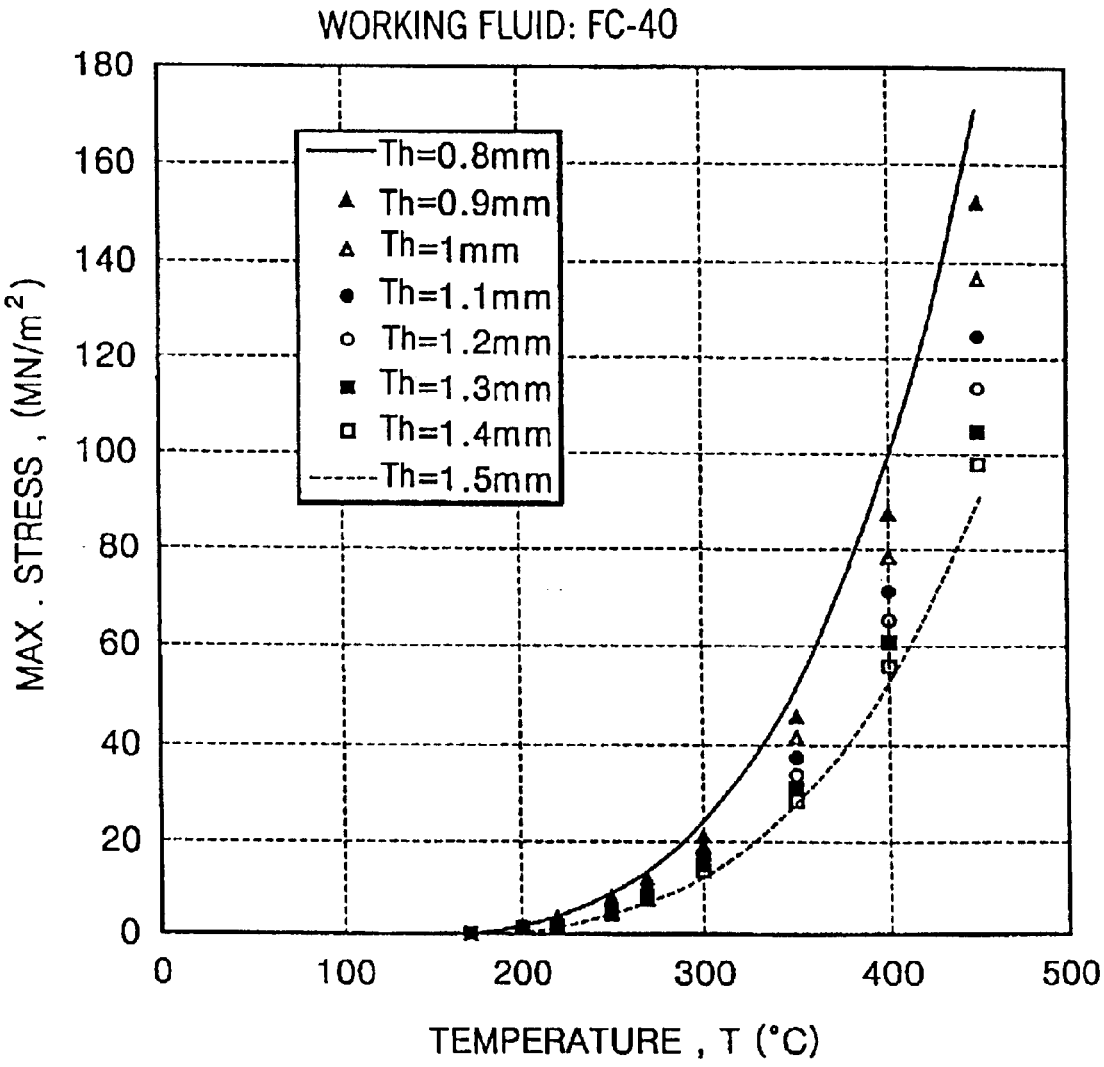
FIGS. 19A and 19B are graphs illustrating the maximum stress variations with respect to the heat pipe thickness (Th) variations when FC-40 and distilled water are respectively used as a working fluid.
Figure 19B:
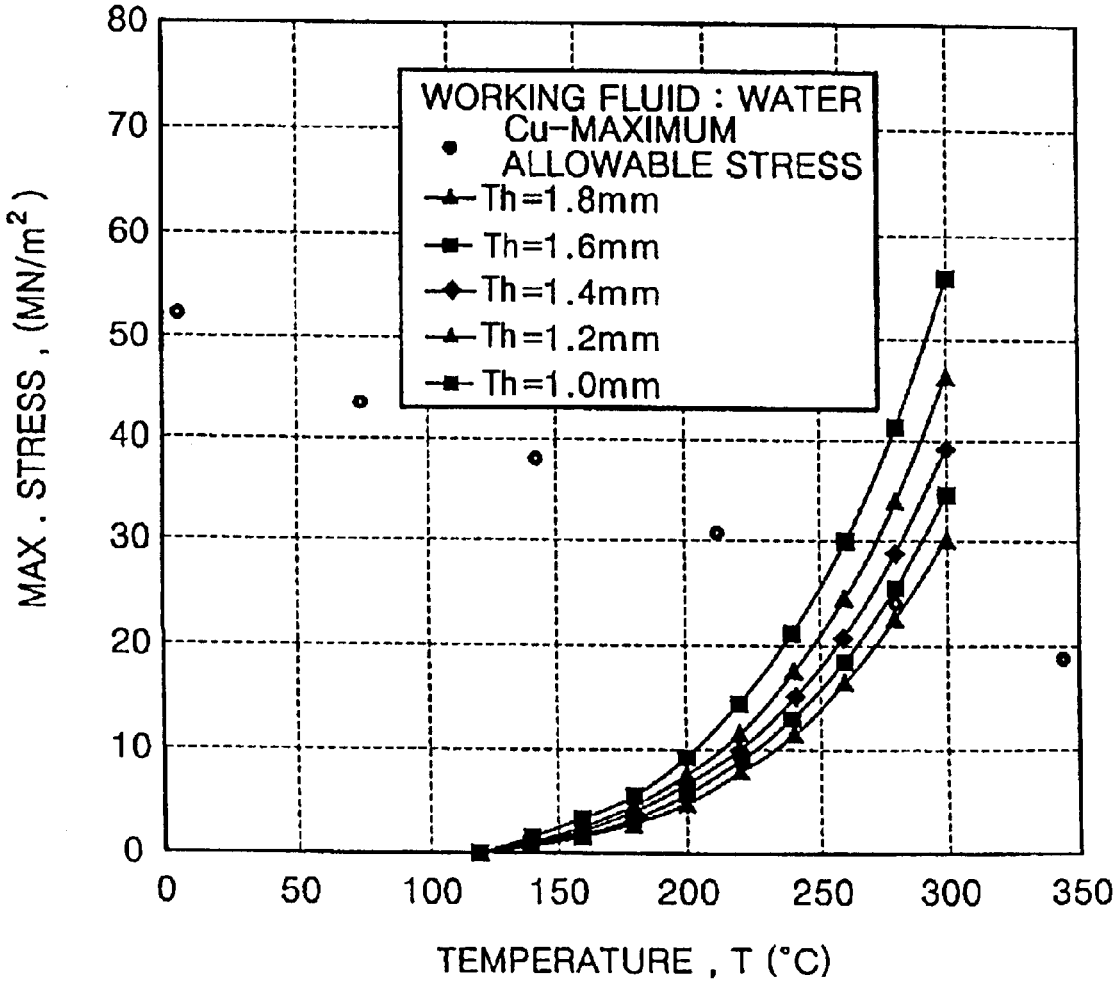

FIGS. 19A and 19B are graphs that illustrate variations in the maximum stress acting upon a heat pipe copper with respect to pipe thickness variations when FC-10 and distilled water are used as a working fluid, respectively over a temperature range that extends from more than 150° C. to less than 500° C. As shown in FIGS. 19A and 19B, although the thickness Th, of the heat pipe varies from 0.8 mm up to 1.5 mm for FC-10 used as a working fluid, and from 1.0 mm up to 1.8 mm for distilled water used as a working fluid, respectively, the maximum stress acting upon the heat pipe does not change very much at an operating temperature greater than approximately 165° C., but less than 200° C.

Figure 20:
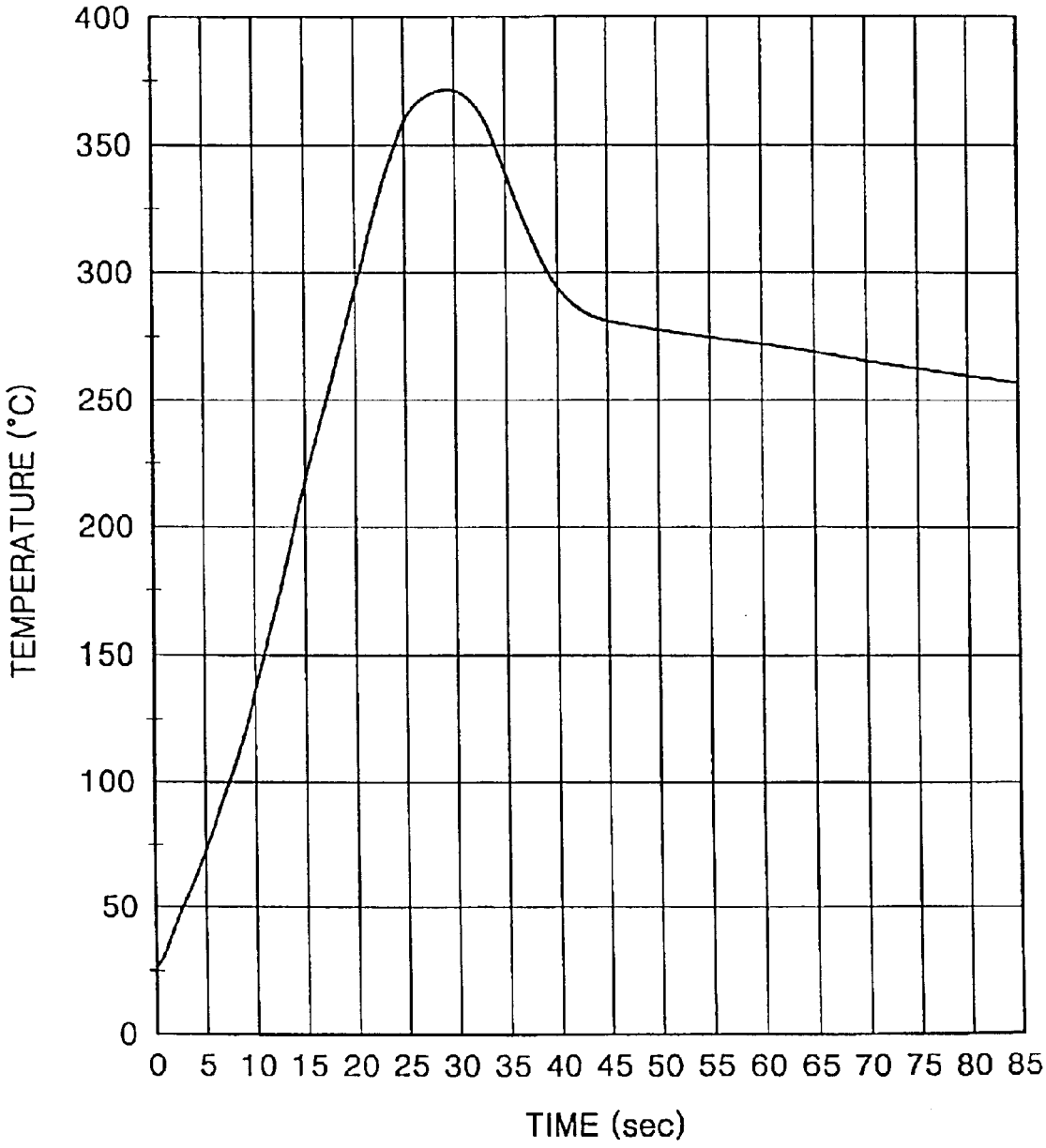
FIGS. 20 and 21 are graphs illustrating the temperature variations in the middle of the fusing roller with respect to time for the first embodiment of the fusing roller apparatus described above.
Figure 21:
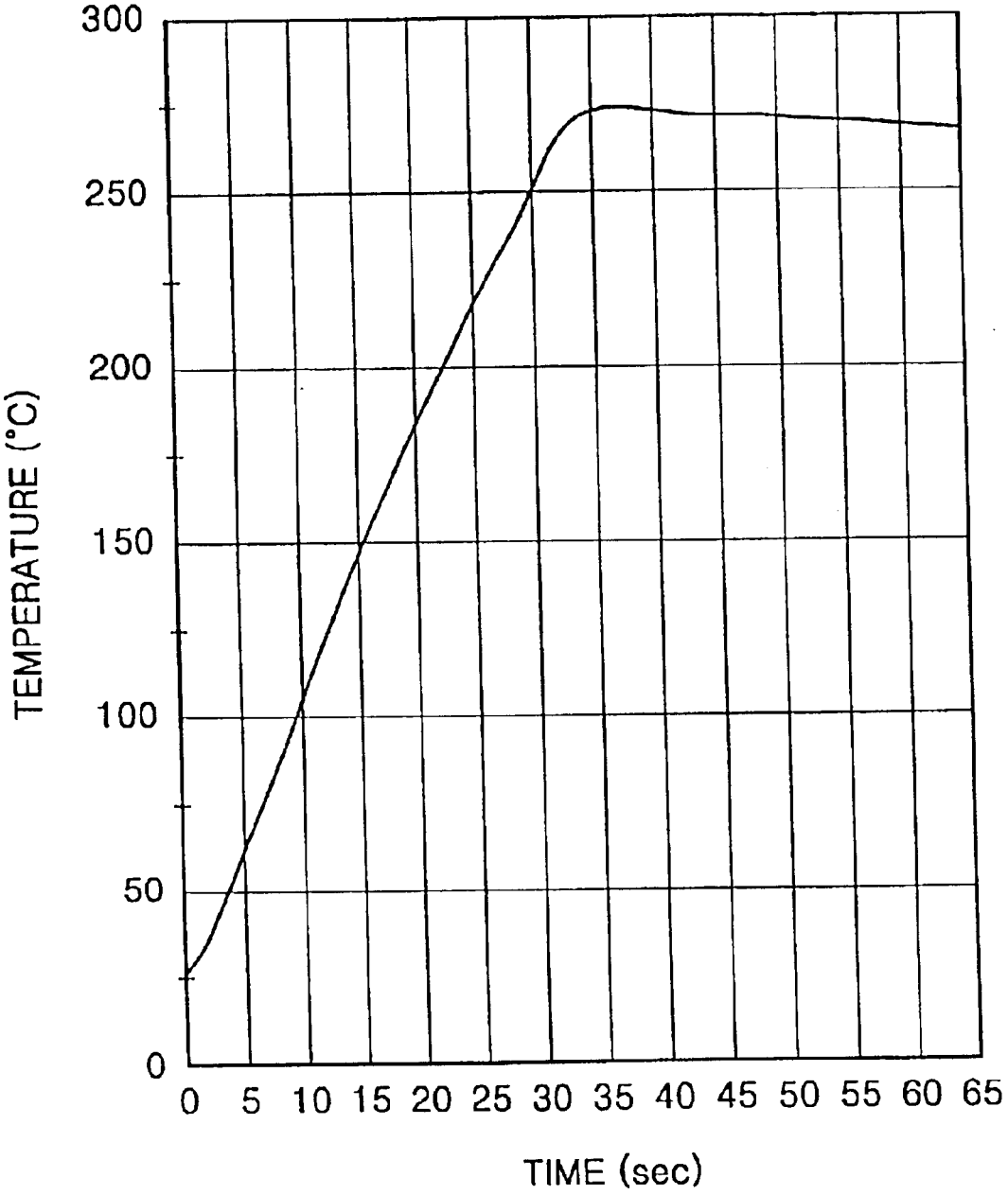

FIGS. 20 and 21 are graphs of the temperature variations (over a range between 0° C. and 400° C.) measured in the middle of the fusing roller with respect to time (over a period between zero and sixty-five seconds) for the first embodiment of the fusing roller apparatus described above. The fusing roller apparatus had a fusing roller made of copper and contains distilled water as a working fluid. The fusing roller had a thickness of 1.0 mm, an outer diameter of 17.85 mm, and a length of 258 mm. This test was performed at a fusing roller rotation rate of 47 rpm with a spiral resistance heating coil resistance of 32 Ω, a voltage of 200V, and an instantaneous maximum power consumption of about 1.5 kW. The spiral resistance heating coil was in direct contact with the inner cylindrical surface of the fusing roller.

FIG. 20 shows measurements for a fusing roller apparatus containing distilled water as a working fluid that occupies 10% of the inner volume of the fusing roller. FIG. 21 shows measurements for a fusing roller apparatus containing distilled water occupying 30% of the volume of the fusing roller. Referring to FIG. 20, this prototype takes about 8 to 12 seconds to raise the temperature of the fusing roller from room temperature of about 22° C. to an operating temperature of about 175° C. and less than 14 seconds to reach 200° C. Referring to FIG. 21, it takes about 13 seconds to raise the temperature of the fusing roller from room temperature of about 22° C. to 175° C. and only about 22 seconds to 200° C.

Comparing the results of FIGS. 20 and 21, it is apparent that the rate of temperature increase varies depending on the volume ratio of working fluid contained in the sealed interior of the fusing roller. According to the results of experiments performed under various conditions, the fusing roller is operable with an amount of working fluid occupying 5–50% of the inner space of the fusing roller. The rate of temperature increase is high with only 5–15% of the volume of the fusing roller filled with working fluid.

Compared with a conventional image forming apparatus in terms of rate of temperature increase, for an image forming apparatus adopting one of the severed possible designs for a fusing roller apparatus according to the present invention, there is no need to continuously supply power to the fusing roller apparatus during the stand-by state. Although the power is supplied when formation of an image starts, a fusing roller apparatus constructed according to the present invention can form an image, i.e., can still fuse a toner image, at a high speed, faster than contemporary equipment.

When the volume of the working fluid is more than 50% by volume, the rate of temperature increase becomes impractically slow. Meanwhile, if the volume of the working fluid is less than 5% by volume, a dry-out phenomenon either occurs or becomes likely to occur due to the insufficient supply of the working fluid, so that the fusing roller either does not function as well or does not function at all as a heat pipe.

In a fusing roller apparatus constructed according to the principles of the principles of the present invention, electrical power can be applied at a voltage of 90–240 volts and a frequency of 50–70 Hz, as well as at higher frequencies.

As described above, the fusing roller apparatus constructed according to the present invention includes a heating coil and a working fluid in the body of the metallic fusing roller having excellent conductivity, so that the surface of the fusing roller can be instantaneously heated up to a target fusing temperature to fix toner images that have been transferred to a print paper. Compared with a conventional halogen lamp type or direct surface heating type fusing roller apparatus using a palladium (Pd), ruthenium (Ru) or carbon (C) based heater, the fusing roller of the present invention can reach a target fusing temperature within a shorter period of time with reduced power consumption and the surface temperature of the fusing roller can be uniformly maintained. The fusing roller apparatus of the present invention needs neither a warm-up and stand-by period, and thus any image forming apparatus, such as a printer, copy machine, or facsimile, equipped with the fusing roller apparatus of the present invention, does not need to supply power to the fusing roller to ready for printing. Thus, overall power consumption of the image forming apparatus is reduced. In addition, the fusing roller apparatus of the present invention is based on the principle of a heat pipe, so that the temperature distribution in the longitudinal direction of the fusing roller can be uniformly controlled, thereby optimally improving toner fusing characteristics.

In addition, the fusing roller apparatus of the present invention can be easily manufactured on a mass scale, and ensure safe operation. The parts of the fusing roller apparatus are compatible with other commercially available parts. The quality of the fusing roller apparatus can be easily controlled. A high-speed printer can be implemented with the fusing roller apparatus according to the present invention.

The fusing roller apparatus and the method for manufacturing the fusing roller apparatus according to the present invention provide the following advantages.

First, the fusing roller apparatus can be manufactured by simple automated processes.

Second, the temperature variations in the axial, or longitudinal direction of the heat pipe are small (within the range of ±1°).

Third, a high-speed printer can be easily implemented with the fusing roller apparatus.

Fourth, the heat source and the heat pipe, which are the main elements of the fusing roller apparatus, are formed as separate units, so that the fusing roller apparatus can be easily manufactured on mass scale and ensures safe operation. The parts of the fusing roller apparatus are compatible with other commercially available parts. The quality of the fusing roller apparatus can be easily controlled.

Fifth, due to continuous vaporization and condensation cycles of the working fluid contained in the sealed heat pipe, although the pressure inside the heat pipe increases at a high temperature (one atmosphere or less at 165° C. for FC40), the risk of explosion or serious deformation is very low.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A fusing roller assembly, comprising:

an external roller having a tube shape with a hollow inside;

an internal roller inserted into the external roller; and a resistive heating coil wound around an exterior surface of the internal roller, said resistive heating coil being electrically connected to a power supply, wherein the internal roller with the resistive heating coil wound around the exterior surface is inserted into the external roller, and a high pressure is applied to an inside of the internal roller to expand the internal roller toward the external roller so that the resistive heating coil can tightly and simultaneously contact the exterior surface of the internal roller and an interior surface of the external roller.

2. The fusing roller assembly of claim 1, said internal roller being made of a material that deforms substantially under pressure while also being thermally conductive.

3. The fusing roller assembly of claim 1, said resistive heating coil simultaneously contacting both said exterior surface of said internal roller and said interior surface of said external roller when said high pressure is applied to said internal roller.

4. The fusing roller assembly of claim 1, said internal roller having a smaller outer diameter than an inner diameter of said external roller, said internal roller being disposed within said external roller and being concentric with said external roller, said resistive heating coil being interposed between said exterior surface of said internal roller and said interior surface of said external roller.

5. The fusing roller of claim 4, wherein spaces between adjacent windings of said resistive heating coil being filled with a thermally conductive spacer, said thermally conductive spacer physically contacting both said exterior surface of said internal roller and said interior surface of said external roller.

6. The fusing roller of claim 1, the internal roller being hollow.

7. The fusing roller of claim 1, said high pressure is applied by introducing additional gas molecules to said inside of said internal roller, said high pressure not being brought about by an increase in temperature.

8. The fusing roller of claim 1, said internal roller being made out of copper.

9. A process of manufacturing a fusing roller assembly, comprising the steps of:

preparing an external roller having a tube shape with a hollow inside;

preparing an internal roller to be inserted into the external roller;

winding a resistive heating coil around an exterior surface of the internal roller;

inserting the internal roller with the resistive heating coil wound around the exterior surface into the external roller; and applying a high pressure to an inside of the internal roller to expand the internal roller outward toward the external roller so that the resistive heating coil can tightly and simultaneously contact the exterior surface of the internal roller and an inside surface of the external roller.

10. The process of claim 9, further comprising the step of evacuating said internal roller to create a vacuum inside said internal roller after said applying step.

11. The process of claim 10, further comprising the step of injecting a working fluid into said internal roller to partially fill said internal roller after said evacuating step.

12. The process of claim 11, further comprising the step of inserting a spacer between the exterior surface of the internal roller and said inside surface of the external roller, said spacer filling gaps between windings of said resistive heating coil.

13. The process of claim 11, wherein prior to and during said inserting step, ends of said resistive heating coil are pulled apart causing said resistive heating coil to press firmly against said exterior surface of said internal roller enabling said internal roller with said resistive heating coil wound around the exterior surface to fit inside said external roller.

14. The process of claim 9, further comprising the step of injecting a working fluid into said internal roller to partially fill said internal roller after said applying step.

15. The process of claim 9, further comprising the step of inserting a spacer between the exterior surface of the internal roller and said inside surface of the external roller prior to said winding step, said spacer filling gaps between windings of said resistive heating coil.

16. The process of claim 9, wherein prior to and during said inserting step, ends of said resistive heating coil are pulled apart causing said resistive heating coil to press firmly against said exterior surface of said internal roller enabling said internal roller with said resistive heating coil wound around the exterior surface to fit inside said external roller.

17. The process of claim 9, said high pressure being achieved by introducing more gas molecules to said inside of said internal roller and not by increasing temperature of an inside of said internal roller.

18. A fusing roller, comprising:

an essentially cylindrical hollow outer roller, said outer roller having an inner surface and an outer surface;

an essentially cylindrical inner tube disposed within said outer roller, said inner tube being concentric with said outer roller, said inner tube being made of a material that deforms when said inner tube is filled with pressurized gas; and a resistive heating coil interposed between an outer surface of said inner tube and said inner surface of said outer roller, wherein ends of said resistive heating coil are connected to a power supply.

19. The fusing roller of claim 18, said inner tube being partially filled with a working fluid.

20. The fusing roller of claim 18, wherein adjacent windings of said resistive heating coil are spaced apart from each other.

21. The fusing roller of claim 20, further comprising a spacer material interposed between said inner surface of said outer roller and an outer surface of said tube, said spacer material filling gaps between windings of said resistive heating coil.

22. The fusing roller of claim 21, said spacer material and said inner tube being made of thermally conductive material.

23. The fusing roller of claim 21, said inner tube being evacuated of all gases and being partially filled with a working fluid.

24. The fusing roller of claim 18, said outer surface of said outer roller being coated with polytetrafluoroethylene.

* * * * *